US007421806B2

(12) United States Patent
Braynock et al.

(10) Patent No.: US 7,421,806 B2
(45) Date of Patent: Sep. 9, 2008

(54) SHOE WITH TRANSPARENT PANELS

(75) Inventors: Stephen Braynock, New Brunswick, NJ (US); Jeffrey Gabriele, New Brunswick, NJ (US)

(73) Assignee: Ingenuity Express Corp., Somerset, NJ (US)

( * ) Notice: Subject to any disclaimer, the term of this patent is extended or adjusted under 35 U.S.C. 154(b) by 0 days.

(21) Appl. No.: 11/244,630

(22) Filed: Oct. 5, 2005

(65) Prior Publication Data

US 2006/0112599 A1 Jun. 1, 2006

Related U.S. Application Data

(60) Provisional application No. 60/615,896, filed on Oct. 5, 2004.

(51) Int. Cl.
*A43B 3/24* (2006.01)
*A43B 17/18* (2006.01)

(52) U.S. Cl. ..... 36/100; 36/136; 2/239

(58) Field of Classification Search ..... 36/136, 36/100, 101, 8.1, 11.5, 3 A; 2/239
See application file for complete search history.

(56) References Cited

U.S. PATENT DOCUMENTS 1,172,736 A * 2/1916 Rice ..... 434/397
1,608,879 A * 11/1926 Hawkins ..... 36/8.4
1,651,631 A * 12/1927 Radway ..... 36/7.2
1,752,254 A * 3/1930 Gosnell ..... 36/8.4
2,271,595 A * 2/1942 Langendorf ..... 36/9 R
2,596,188 A * 5/1952 Webb ..... 36/11.5
2,801,477 A * 8/1957 Adams et al. ..... 40/636
2,982,033 A * 5/1961 Bingham, Jr. ..... 40/636
3,319,360 A * 5/1967 Nadler ..... 36/4
3,396,480 A * 8/1968 Sherman ..... 36/112
3,613,271 A * 10/1971 Geller ..... 36/117.6

(Continued)

OTHER PUBLICATIONS

Clear Dunk—White Dunk Tokyo Sneaker Showcase (unreleased) website—http://www.freshnessmag.com/content/features/files/1105/white_dunk_unreleased/index.php and http://www.freshnessmag.com/content/features/files/1105/white_dunk_unreleased/index002.php, © 2005, printed Jan. 20, 2006.

(Continued)

*Primary Examiner*—Ted Kavanaugh
(74) *Attorney, Agent, or Firm*—Leason Ellis LLP

(57) ABSTRACT

The present invention relates to a footwear system that is comprised of a pair of footwear with at least one transparent, semi-transparent or translucent special display area(s) (SDA) and system of innerliners. The system of innerliners can be comprised of either at least two user interchangeable pairs of innerliners or a single pair of innerliners that can provide multiple combined appearances from the footwear, when the innerliners are switched from one foot to the other, reversed or rotated on the foot. The innerliners are specifically designed and engineered to be displayed through the footwear, and the footwear is specifically designed and engineered to display the innerliners providing an emanating effect. The present invention provides a large number of user desirable combinations of footwear with SDA and innerliners that can be created by using a footwear system comprised of footwear with at least one SDA and a system of specifically designed innerliners. Users can create multiple combined appearances from a single pair of footwear by simply changing or modifying their innerliners.

17 Claims, 31 Drawing Sheets

U.S. PATENT DOCUMENTS

| | | | | |
|---|---|---|---|---|
| 4,187,619 | A | 2/1980 | Gibbs | |
| 5,379,533 | A | 1/1995 | Swartz | |
| 5,659,979 | A * | 8/1997 | Sileo | 36/54 |
| 5,771,495 | A * | 6/1998 | Turner et al. | 2/239 |
| 6,115,948 | A | 9/2000 | Mitchell | |
| 2002/0083617 | A1 * | 7/2002 | Tsou et al. | 36/8.4 |
| 2005/0022288 | A1 * | 2/2005 | Habert | 2/239 |
| 2005/0086726 | A1 * | 4/2005 | Poole | 2/239 |

OTHER PUBLICATIONS

Hypebeast—Sneakers, Fachion, Trends and More: Clear AFT, website—http://www.hypebeast.com/archives/2005/11/clear_af1.php, posted Nov. 20, 2005, printed Jan. 20, 2006.

Hypebeast—Sneakers, Fashion, Trends and More: Nov. 2005 Archives, Sandy Bodecker Wearing New Dunk SB, website—http://www.hypebeast.com/archives/2005/11/index.php?page=2, posted Nov. 20, 2005, printed Jan. 20, 2006.

New Balance Kids KV 423 WNI (Children)—Hook and Loop Athletic (White/Navy), website—http://www.zappos.com/n/p?dp=10385846&c=751, printed Jan. 20, 2006.

ESPN Shop: Product Detail, Asics Women's Gel Cheer LE, Gel Cheer Diva and Gel Cheer III & III Youth, website—http://www.espnshop.com/espn/index.jsp?Id=espnPDP&Slot1.atgProductId=4570101&SID=9436, © 2006, printed Jan. 20, 2006.

* cited by examiner 31
34
34
33
32

36
36A
36B
36C
36D
36E
Michael Jordan
#23

31
36
36E
34 (36A)
34 (36B)
34 (36C)
34 (36D)
Michael Jordan
#23

61
64A
64C
64B
62
63
64C 61
64A (66A)
66
66C
64C
64B (66B)
64C 66A
66
66D
66C
66B 121
124A
124B
122
123
124C 126
126D
126A
126B
126C
Red Bull 121
124A (126A)
126
126D
124B (126B)
124C (126C)
Red Bull 131
134
132
135
135A
135B
135C
133

136
136A 136
131
134 (136A)
135
135A (136)
135B (136)
135C (136)

181
183
184
185
182

186
186A 181
185
186
186A
184

171
173
174
175
172

176
176A
176B 171
175
176
176A
176B
174

SHOE WITH TRANSPARENT PANELS

CROSS-REFERENCE TO RELATED APPLICATION

This application claims priority to U.S. Provisional Patent Application Ser. No. 60/615,896, which was filed on Oct. 5, 2004, and which is incorporated herein by reference.

TECHNICAL FIELD

The present invention relates to footwear, and more particularly, to footwear with at least one display area that overlaps in a specific predetermined manner with an innerliner to display the innerliner.

BACKGROUND

Conventional footwear having transparent and translucent areas that can display an underlying sock have been available for some time, e.g., Jellies®, Melissa Love System®, Adidas Clima Response/Cool® or Nike Air Max Rival®. The first reference to this concept identified was in 1697 when Charles Perrault included glass slippers in his version of the tale of Cinderella. A user could use such footwear with a conventional sock, such as one having a single color, so that the color of the sock would be visible through the footwear. In the art, U.S. Pat. No. 2,887,792 to Staff notes that, at the time of that patent, women's shoes with transparent uppers were popular and they allowed the stockings of the wearer to be visible. Staff discloses a transparent woman's dress shoe that uses a consumer changeable plastic insert to change the appearance of the shoe. U.S. Pat. No. 5,659,929 to Sileo has a transparent sole and upper so its decorated and exchangeable tongue and insole can be viewed. Coordinated shoelaces may also be used. U.S. Pat. No. 6,711,836 to Weiss also presents the concept of an exchangeable device to alter the appearance of footwear in the form of a removable member, an elongated insole.

Additionally, U.S. Pat. Nos. 2,982,033, 3,319,360 and 4,096,650 to Bingham, Nadler, and Seidel, respectively, disclose transparent boots that use a liner to influence the appearance of the boot in which the liner is permanently attached during the manufacturing process. A version of the Nike Air Zoom UltraFlight® provides a clear plastic shell that allows a single removable sock-liner provided with the footwear to be displayed therethrough. The Nike Air Force II Espo® provides a sneaker with transparent areas and an associated flat blue sock with a white swoosh, representing the company's logo, to be displayed through the footwear. Cheer Athletic® provides a sneaker with a mesh display area and Severe Socks® with flat colors that allow the user to alter the color of the area on the shoe by displaying the different flat colored socks. Nike® also provides a line of Michael Jordan Sandals that have an associated sock whose color pattern aligns with the color pattern on the sandal. Crocs® provide a sandal with circular and oval cut out/open areas and a line of socks that have a design that emulates the layout of cut out/open areas on the sandal. When the sandals and socks are worn in conjunction a section of the sock may align with a section of the cut out/open areas on the sandal, loosely displaying a portion of the sock's design through the sandal.

Several patents disclose cutout or window sections of footwear, which allow a picture placed inside or on the footwear to be seen. For example, U.S. Pat. No. 4,852,276 to Adamik and U.S. Pat. No. 4,852,276 to Savoca provide a transparent pouch on the outside of the footwear for displaying materials inserted in the pouch, and U.S. Patent Application Publication No. 2004/0025373 to Schuver et al. discloses a window to the interior of the footwear for viewing indicia for sizing purposes.

Several additional patents and patent applications address changeable footwear. U.S. Pat. No. 5,083,385 to Halford provides interchangeable uppers that allow the footwear to be readily transformable. U.S. Patent Applications No. 2004/0172853, No. 2004/0187351 and 2005/0102856 disclose footwear with a rotating tongue that can be turned to provide a second appearance to the footwear. A product utilizing this technology called the Varados®, with Tongue Twister®, have transparent mesh stripes that can display the appearance of the elongated tongue, and are currently marketed by K-Swiss®. U.S. Patent Application No. 2005/0016032 discloses a changeable stripe for footwear having a pull tab connected to the stripe that can be shifted in one direction or the other to disclose different surface features of the stripe, in order to vary the coloration or design of the stripe that is visable. A product utilizing this technology called the Wallis, with Stripe Shifter, is currently marketed by K-Swiss®.

None of the above inventions or products provide a footwear system having footwear with at least one transparent, semi-transparent, and/or translucent display area and a system of specifically designed user interchangeable innerliners that allow the user to rapidly, easily, and effectively alter the appearance of their footwear to achieve multiple predetermined combined appearances by simply changing the innerliners.

SUMMARY OF THE INVENTION

The present invention relates to a footwear system that is comprised of a pair of footwear with at least one transparent, semi-transparent or translucent special display area(s) (SDA) and a system of innerliners. The system of innerliners includes at least two pairs of user interchangeable innerliners or a single pair of innerliners that can provide multiple combined appearances from the footwear, when the innerliners are switched from one foot to the other, turned inside out (reversed) or rotated on the foot. The innerliners have an area or areas that are specifically designed to be displayed through the display area of the footwear, and the footwear is specifically designed to display the innerliners.

The user can readily remove the innerliner from the footwear. The innerliner can be worn on the foot and placed into the footwear or inserted into the footwear and placed onto the foot as a unit. The innerliner is visible through at least one SDA located on the footwear. The SDA extends from the outer surface of the footwear to the interior of the footwear where the innerliner-covered foot is located. The design and appearance of the innerliner and the SDA contribute to a user desirable combined appearance when portions of the innerliner are visible through the SDA and viewed along with the non-SDA portions of the footwear. A series of different innerliners can be provided to coordinate with a specific model of footwear so that the different innerliners can be interchanged by the user to provide the user with multiple different combined appearances from a single pair of footwear. Furthermore, a single innerliner can provide specifically planned combined appearances with at least two models of footwear, further increasing the utility provided by the invention.

The innerliners can be designed to provide a different combined appearance based on which foot the innerliner is worn on. Users can change the combined appearance of their footwear by removing their footwear, switching their innerliners from one foot to the other and replacing them in the footwear.

The innerliners can be designed to provide a different combined appearance by reversing the innerliner. Users can change the combined appearance of their footwear by removing their footwear, turning the innerliners inside out and replacing them in the footwear. The innerliners can be designed to provide a different combined appearance by rotating the innerliner on the foot. Users can change the combined appearance of their footwear by removing their footwear, turning the innerliners, e.g. 90 or 180 degrees, and replacing them in the footwear. Each of these components of the innerliner system multiply the number of potential combined appearances that are possible from one pair of innerliners and provide the user with the ability to alter the appearance of their footwear when an additional pair of innerliners is not readily available.

The innerliner can be designed to have one or more specific areas that align with one or more corresponding SDA on the footwear. For example, an innerliner can have three sections with different colors, such that each aligns with a specific SDA of the footwear, thus resulting in a different appearance for each SDA.

The SDA may effect and/or interact with the innerliner. For example, a yellow SDA covering a blue innerliner would create a green appearance. In another example, the SDA may take on some or all of the appearance, e.g., color, of the innerliner. Through a process referred to as Emanation, the SDA may effect and/or interact with an innerliner in a manner such that some or all of the appearance, e.g. color or design, of the innerliner may appear to originate from and/or be seamlessly integrated with the SDA, thus obscuring from an external observer that an innerliner is being utilized to alter the appearance of the footwear. The SDA may also effect and/or interact with the innerliner by: magnifying an image on or attribute of the innerliner; brightening or darkening the appearance of the innerliner; filtering specific colors from an innerliner; providing a three-dimensional appearance within the SDA; and incorporating non-transparent sparkles in the SDA.

The present invention also incorporates various technological advances that help to overcome many of the complexities of providing a user interchangeable innerliner that is easily and effectively displayed through specific portions of specifically designed footwear with at least one SDA and maintains this ability through normal use over the life cycle of the product. These technological advances allow for the creation of a multitude of specific consumer desirable combined appearances that are possible through the precise interrelation of an innerliner, SDA, and remaining non-SDA portion of the footwear. These advances contribute to the system by increasing the precision of the combined appearances, increasing the user desirability of the combined appearances and increasing user comfort during use of the footwear with the SDA and the innerliners. Mechanisms utilized to achieve these results may include the use of interrelated topography on the exterior surface of the innerliner and interior surface of the upper of the footwear and/or the SDA. Additionally, strength bands may be used to manage the movement of the innerliner on the foot and the foot within the footwear. Further, the incorporation of coordinated wicking and venting materials into the innerliner and footwear may help remove excess moisture and heat, e.g. that may accumulate under and around the SDA during use. Also, the incorporation of various materials into the innerliners may act to manage its spatial relationship with the SDA or enhance the combined appearance thereof.

Thus, the present invention allows users to rapidly, easily, and effectively alter the appearance of their footwear by simply changing, switching or modifying their innerliners. Additionally, the present invention provides for a large number of combinations of user desirable footwear with at least one SDA and specifically designed innerliners that can be created by using a footwear system that incorporates footwear with at least one SDA and a system of specifically designed innerliners. Users can create multiple combined appearances from a single pair of footwear by simply switching, changing or modifying their specifically designed innerliners.

BRIEF DESCRIPTION OF THE DRAWINGS

The foregoing and other features of the present invention will be more readily apparent from the following detailed description and drawings of the illustrative embodiments of the invention wherein like reference numbers refer to similar elements and in which.

DETAILED DESCRIPTION OF THE PREFERRED EMBODIMENTS

FIGS. 1A-1I illustrate various combinations of footwear of the present invention and multiple innerliners according to various embodiments of the present invention. The footwear system of the present invention includes the footwear with SDA and a system of innerliners.

Footwear

The footwear according to the present invention typically includes a sole and an upper, which is the part of the footwear disposed above the sole. The footwear can be of any type, such as sneakers, shoes, boots, moccasins, slippers, rollerblades and ice skates. The innerliner can be any type, such as socks, hosiery, stockings, a two-part liner, an inner layer of traditional footwear, a flexible shell, which is contiguous, but not necessarily continuous around at least a portion of a user's foot. The innerliner does not necessarily encompass the whole foot. Examples of potential innerliner materials include, but are not limited to, cotton, Spandex, nylon, rayon, lycra, silk, jute, polyester, wool, CoolMax, Spandex, leather, plastic, thermoplastic, PVC, EVA, sponge, foam, elastic, Velcro®, rubber and Teflon®.

At least a portion of the upper of the footwear includes at least one special display area (SDA). The SDA is made of transparent, semi transparent or translucent materials. The SDA may also be a structure that contains physical openings that allow the transmission of light. Examples of potential SDA materials include, but are not limited to sheets of polyvinyl chloride (PVC), thermoplastic urethane (TPU), polycarbonate, acrylic, silicone, polypropylene, polyester, water, helium, neon, air, Licron, Grip-Gard®, AdNano™, Teflon®, coatings and pigments dyes. Examples of structures of the SDA include, but are not limited to, solid, mesh, webbing, weave, gauze and sheer. The SDA allows light to travel from an interior surface to an exterior surface of the footwear. The SDA can cover a small area of the footwear, a medium-sized area of the footwear, or almost the entire upper of the footwear.

Figure 1A:
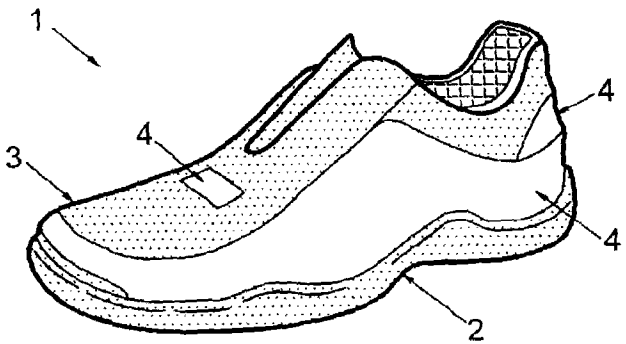
FIG. 1A is a perspective view of footwear according to a first embodiment of the present invention.

FIG. 1A illustrates a first embodiment of the footwear 1 of the present invention having a sole 2 and an upper 3. The footwear 1 includes several SDAs, 4 located at the top of the upper 3, a central portion of the rear of the upper 3, and around the sides, front, and rear of the upper 3. As an example, in this embodiment of the invention, the non-SDA portions of the footwear 1 may be black.

Innerliner

Multiple innerliners with different appearances are provided for each model of footwear, thereby allowing users to rapidly, easily, and effectively alter the appearance of their footwear by simply changing their innerliners.

In the present invention, the interchangeable innerliners are worn in conjunction with the footwear to allow at least one area of the innerliner to be displayed through at least one SDA on the footwear. The innerliners are designed to be worn with at least one model of footwear with the SDA. Specific areas of the innerliners are displayed through the SDA or a portion of the SDA. When the footwear displays the innerliner through the SDA, the resulting appearance, combined with its interrelation with the appearance of the other non-SDA portions of the footwear, provide an overall unique, user desirable combined appearance. This user desirable combined appearance can be maintained during the normal usage of and over the life cycle of the footwear and innerliners. The combined appearance is reproduced when the innerliner of the present invention is worn with a particular model of footwear with an SDA for which the innerliner is specifically designed, and the innerliner is displayed through the SDA in the footwear.

The combined appearance is user desirable because the combination of the SDA and the specifically designed innerliner create a pleasing appearance, i.e., color, pattern, arrangement, picture, indicia, log, when displayed as desired by the user.

Figure 1B:
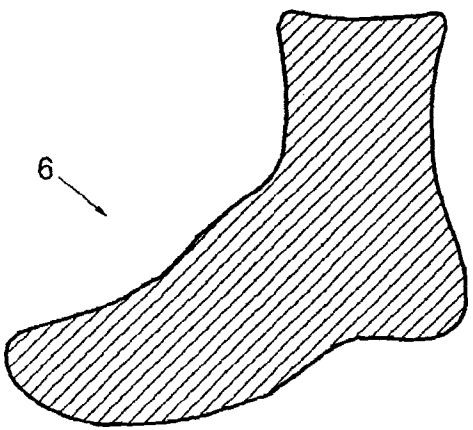
FIG. 1B is a perspective view of a single color innerliner designed for use with the footwear of FIG. 1A according to the first embodiment of the present invention.
Figure 1C:
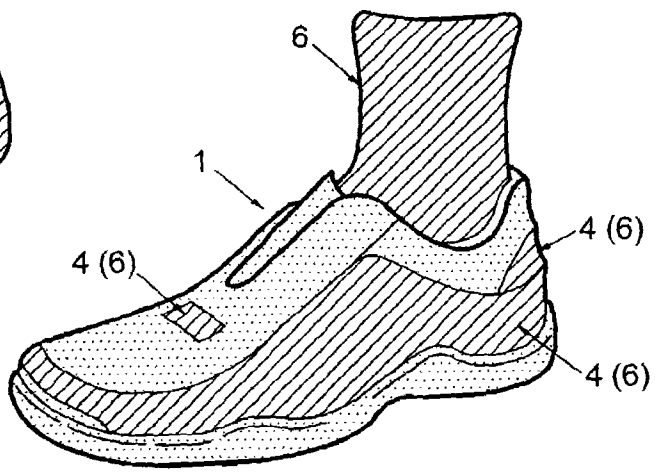
FIG. 1C is a perspective view of the combination of the footwear and innerliner of FIGS. 1A and 1B, respectively.

FIG. 1B illustrates an embodiment of an innerliner 6, which is entirely of one color, e.g., black. FIG. 1C illustrates the combination of the footwear 1 shown in FIG. 1A and the innerliner 6 shown in FIG. 1B. The combination of the all-black innerliner 6 and the footwear 1 having black non-SDA portions results in a combined appearance where the appearance of the footwear is all black, as shown in FIG. 1C, and gives the appearance of a dress shoe.

In the figures, the reference character shown in parentheses ("( )") next to the reference character indicating a SDA, e.g., SDA 4, on the footwear indicates the reference number of the portion of the innerliner which is seen through the SDA. For example, in FIG. 1C, reference character "4 (6)" indicates that the all-black innerliner 6 is visible through the particular SDA 4.

Figure 1D:
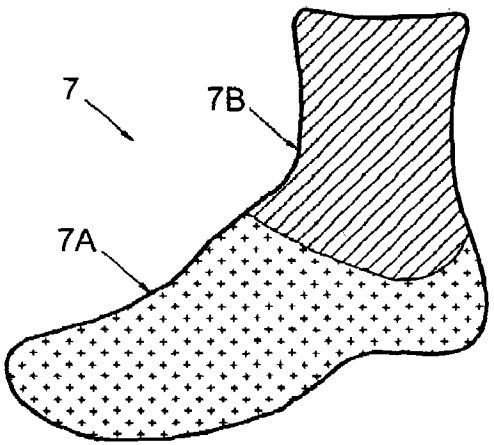
FIG. 1D is a perspective view of a two color innerliner designed for use with the footwear of FIG. 1A according to the first embodiment of the present invention.
Figure 1E:
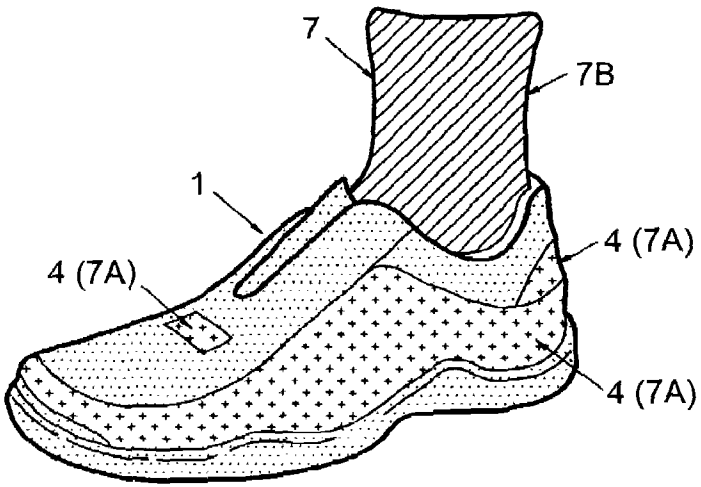
FIG. 1E is a perspective view of the combination of the footwear and innerliner of FIGS. 1A and 1D, respectively.

FIG. 1D illustrates an embodiment of an innerliner 7, which has two colors, e.g., a grey-colored bottom portion 7A and a black-colored ankle portion 7B. FIG. 1E illustrates the combination of the footwear 1 shown in FIG. 1A and the innerliner 7 shown in FIG. 1D. The grey-colored bottom portion 7A is designed to be positioned inside the footwear 1 when the innerliner 7 and the footwear 1 are placed on the user's foot. The combination of the innerliner 7 and the footwear 1 results in a combined appearance that includes the grey-colored bottom portion 7A being visible through the SDA 4 in the footwear 1, as shown in FIG. 1E.

The innerliners of the present invention are interchangeable with at least one model of footwear so that when the innerliners are worn with the footwear, specific portions of the innerliners are visible through the SDA in the footwear, thereby creating a unique, user desirable combined appearance in coordination with the particular model of footwear. Thus, the innerliners can be designed having particular portions that are intended to be shown only through one or more predetermined SDAs on the footwear. Therefore, the positioning of the design and attributes of the innerliners relative to the SDA can be important, as shown by the embodiments of the invention described below.

Figure 1F:
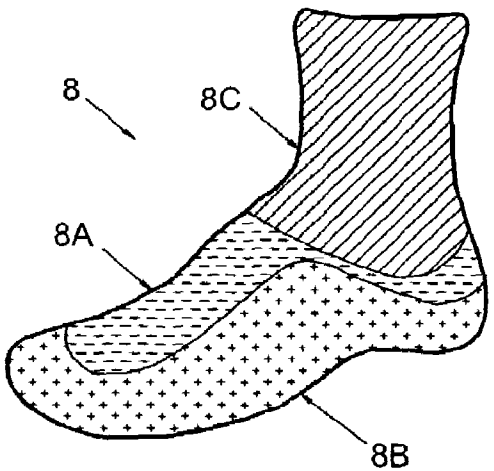
FIG. 1F is a perspective view of a three color innerliner designed for use with the footwear of FIG. 1A according to the first embodiment of the present invention.
Figure 1G:
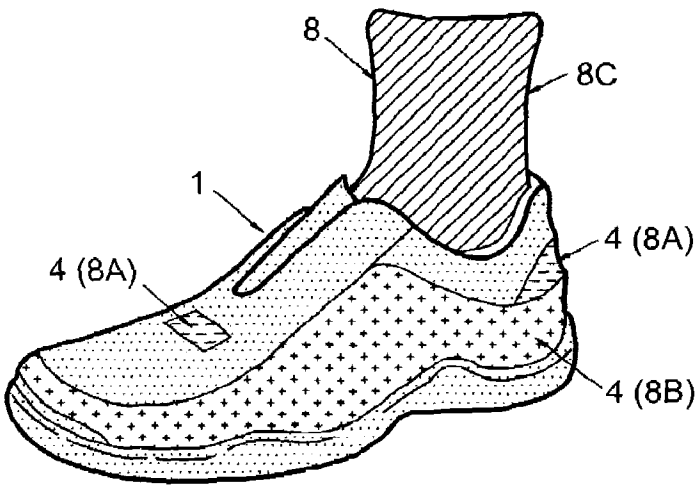
FIG. 1G is a perspective view of the combination of the footwear and innerliner of FIGS. 1A and 1F, respectively.

FIG. 1F illustrates an embodiment of an innerliner 8, which has three colored portions or sections, e.g., a white-colored top portion 8A, a grey-colored bottom portion 8B, and a black-colored ankle portion 8C. FIG. 1G illustrates the combination of the footwear 1 shown in FIG. 1A and the innerliner 8 shown in FIG. 1F. The white-colored top portion 8A and grey-colored bottom portion 8B are adapted to be positioned inside the footwear 1 when the innerliner 8 and the footwear 1 are placed on the user's foot. The combination of the innerliner 8 and the footwear 1 results in a combined appearance in which the white-colored top portion 8A is visible through the SDA 4 at the top and the central portion of the rear of the upper 3, and the grey-colored bottom portion 8B is visible through the SDA 4 that spans the sides, front, and rear of the upper 3 in the footwear 1, as shown in FIG. 1G. Thus, the innerliners provide different predetermined and precise appearances through different SDA on the footwear.

Figure 1I:
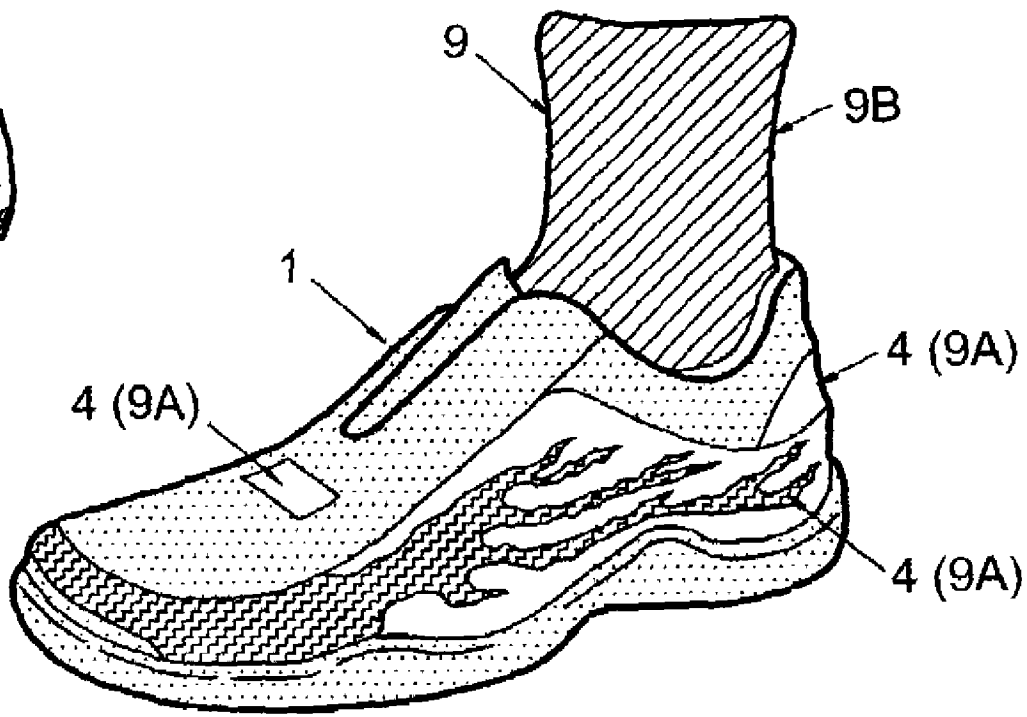
FIG. 1I is a perspective view of the combination of the footwear and innerliner of FIGS. 1A and 1H, respectively.
Figure 1H:
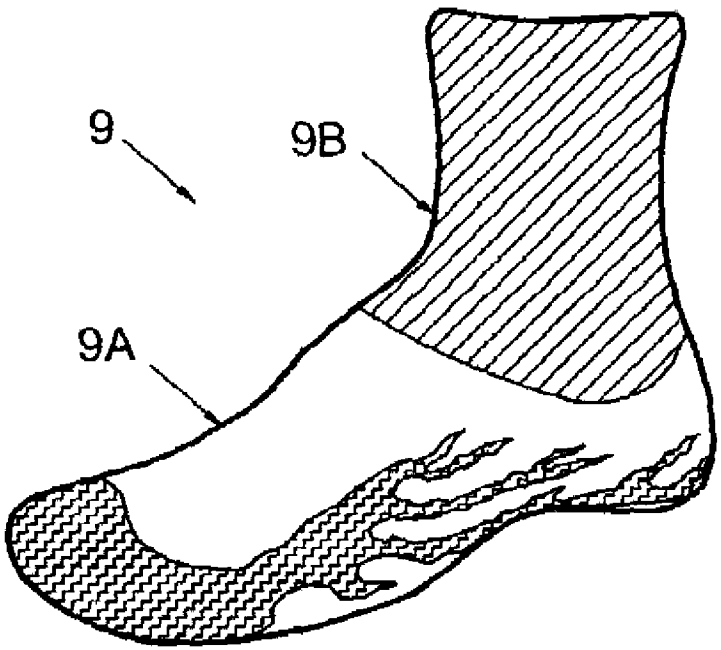
FIG. 1H is a perspective view of a multicolor innerliner with an image designed for use with the footwear of FIG. 1A according to the first embodiment of the present invention.

FIG. 1H illustrates an embodiment of an innerliner 9, which has a bottom portion 9A that is decorated with an image or graphical representation, e.g., of a flame, with a background color that is darkest at the toe of the innerliner 9 and fades towards the rear of the innerliner 9. The innerliner 9 also includes an ankle portion 9B that is of a different color, e.g., white. FIG. 1I illustrates the combination of the footwear 1 shown in FIG. 1A and the innerliner 9 shown in FIG. 1H. This combination shown results in footwear that appears adorned with a flame with a background color that is darkest at the toe and fades towards the rear of the footwear 1, as shown in FIG. 1I. Thus, from FIGS. 1A-1I, it should be apparent that the footwear 1 can have dramatically different appearances based on the design of the innerliner and its interrelation with SDA on the footwear. For example, FIG. 1C shows a conservative black dress shoe whereas FIG. 1I has a more casual appearance.

Figure 2D:
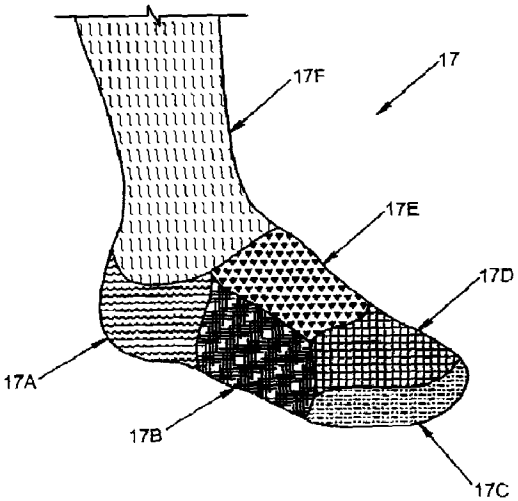
FIG. 2D is a perspective view of an innerliner with multiple segments of different colors, which is designed for use with the footwear of FIG. 2A according to the second embodiment of the present invention.

There are various ways in which the SDA can be positioned on the footwear, and there are various ways to design the innerliner to coordinate with the SDA on the footwear. FIG. 2A illustrates a second embodiment of footwear 11 of the present invention having a sole 12 and an upper 13. The footwear 11 includes several SDA 14 located at various positions on the upper 13. In this embodiment of the invention, the non-SDA portions of the footwear 11 can be various colors, e.g., black and white.

Figure 2B:
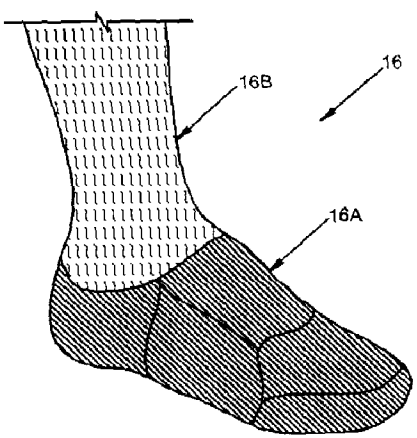
FIG. 2B is a perspective view of a two color, innerliner designed for use with the footwear of FIG. 2A according to the second embodiment of the present invention.
Figure 2E:
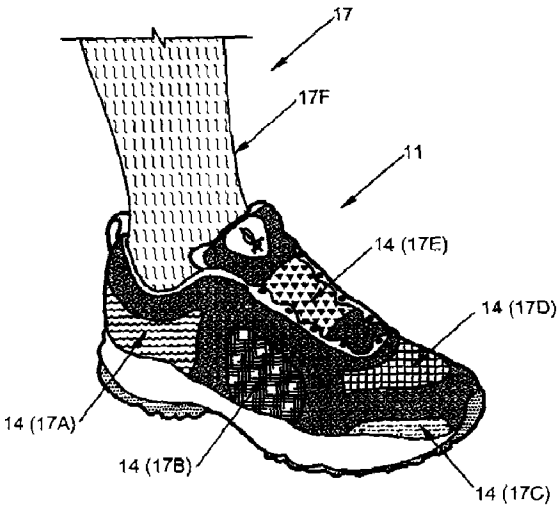
FIG. 2E is a perspective view of the combination of the footwear and innerliner of FIGS. 2A and 2D, respectively.
Figure 2C:
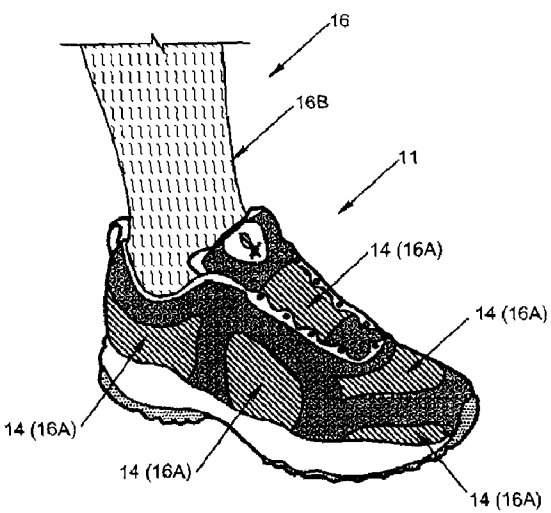
FIG. 2C is a perspective view of the combination of the footwear and innerliner of FIGS. 2A and 2B, respectively.
Figure 2A:
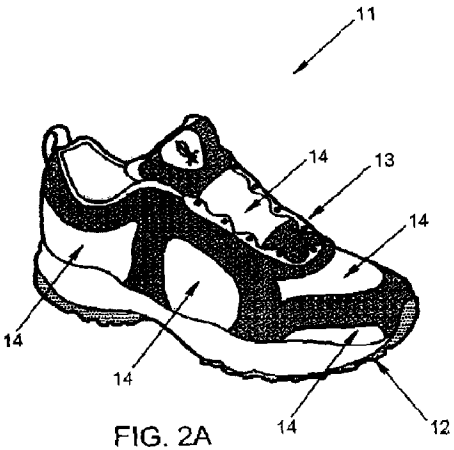
FIG. 2A is a perspective view of footwear according to a second embodiment of the present invention with multiple special display areas.

FIG. 2B illustrates an embodiment of a segmented innerliner 16, which has a single-colored bottom portion 16A, which may be grey, and a different-colored ankle portion 16B, which may be white. The lines on the grey-colored bottom portion 16A indicate the boundaries of the areas or segments of the innerliner 16. FIG. 2C illustrates the combination of the footwear 11 shown in FIG. 2A and the innerliner 16 shown in FIG. 2B. The combination of the innerliner 16 and the footwear 11 results in a combined appearance in which the grey-colored bottom portion 16A is visible through the SDA 14 in the footwear 11, as shown in FIG. 2C.

FIG. 2D illustrates an embodiment of an innerliner 17, which has a multi-colored bottom portion with different-colored segments or panels, e.g., a yellow panel 17A, a blue panel 17B, a red panel 17C, a yellow panel 17D, a red panel 17E, and a white-colored ankle portion 17F. Each segment 17A, 17B, 17C, 17D, 17E of the multi-colored bottom portion of the innerliner 16 is designed to be positioned under the respective SDA 14 on the footwear 11. FIG. 2E illustrates the combination of the footwear 11 shown in FIG. 2A and the innerliner 17 shown in FIG. 2D. The combination of the innerliner 17 and the footwear 11 results in a combined appearance which includes the panels 17A, 17B, 17C, 17D, 17E of the multi-colored bottom portion being visible through the respective SDA 14 in the footwear 11, as shown in FIG. 2E. Thus, with the innerliner 16 shown in FIG. 2B, the footwear 11 is black, white, and grey. With the innerliner 17 shown in FIG. 2D, the footwear 11 is black, white, yellow, red, and blue. Thus, in this case, multiple colors are displayed through multiple SDA, and the tongue of the footwear, through which red panel 17E is visible, is a SDA.

Figure 3A:
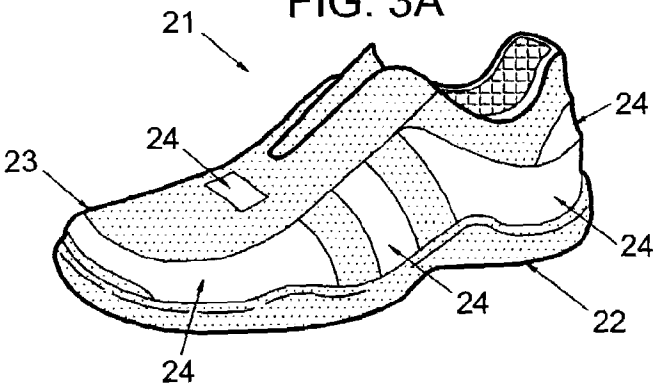
FIG. 3A is a perspective view of multiple segment footwear according to a third embodiment of the present invention.

FIG. 3A illustrates a third embodiment of footwear 21 of the present invention having a sole 22 and an upper 23. The footwear 21 includes several SDAs 24 located at various positions on the upper 23, including SDA 24, that are shaped as stripes on the top and the sides of the upper 23. Other SDAs 24 are located on the front and rear of the upper 23 and extend to the sides of the upper 23. In this embodiment of the invention, most of the non-SDA portions of the footwear 21 may be black.

Figure 3B:
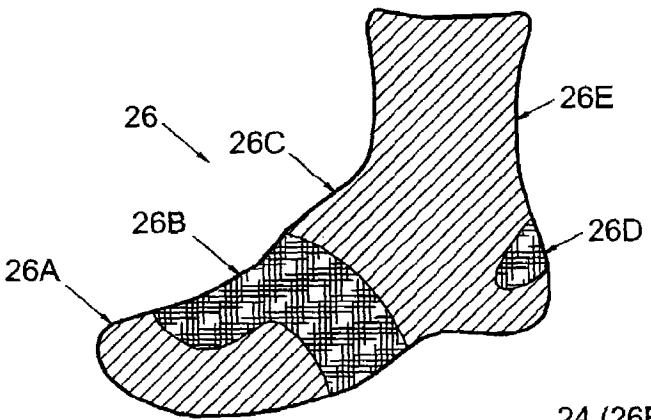
FIG. 3B is a perspective view of an innerliner with multiple segments of different colors designed for use with the footwear of FIG. 3A according to the third embodiment of the present invention.
Figure 3C:
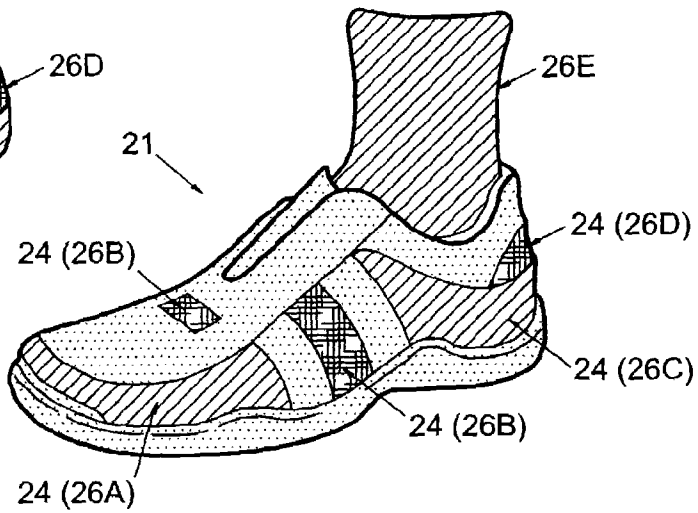
FIG. 3C is a perspective view of the combination of the footwear and innerliner of FIGS. 3A and 3B, respectively.

FIG. 3B illustrates an embodiment of an innerliner 26, which has multiple colored sections, e.g., a black-colored bottom portion 26A and middle portion 26C, a light grey-colored striped portion 26B and rear portion 26D, and a dark grey-colored ankle portion 26E. FIG. 3C illustrates the combination of the footwear 21 shown in FIG. 3A and the innerliner 26 shown in FIG. 3B. The combination of the innerliner 26 and the footwear 21 results in a combined appearance in which the black-colored bottom portion 26A and middle portion 26C and the light grey-colored rear portion 26D are visible through the SDA 24 in the footwear 21 and the light grey-colored striped portion 26B is visible through the striped SDA 24 on the top and sides of the footwear 21, as shown in FIG. 3C. The footwear 21 of FIG. 3A is nearly the same as the footwear 1 of FIG. 1A, except for the stripe, which creates an additional viewing area 24 and thus a whole new set of potential combined appearances.

Figures 4A, 4B, 4C:
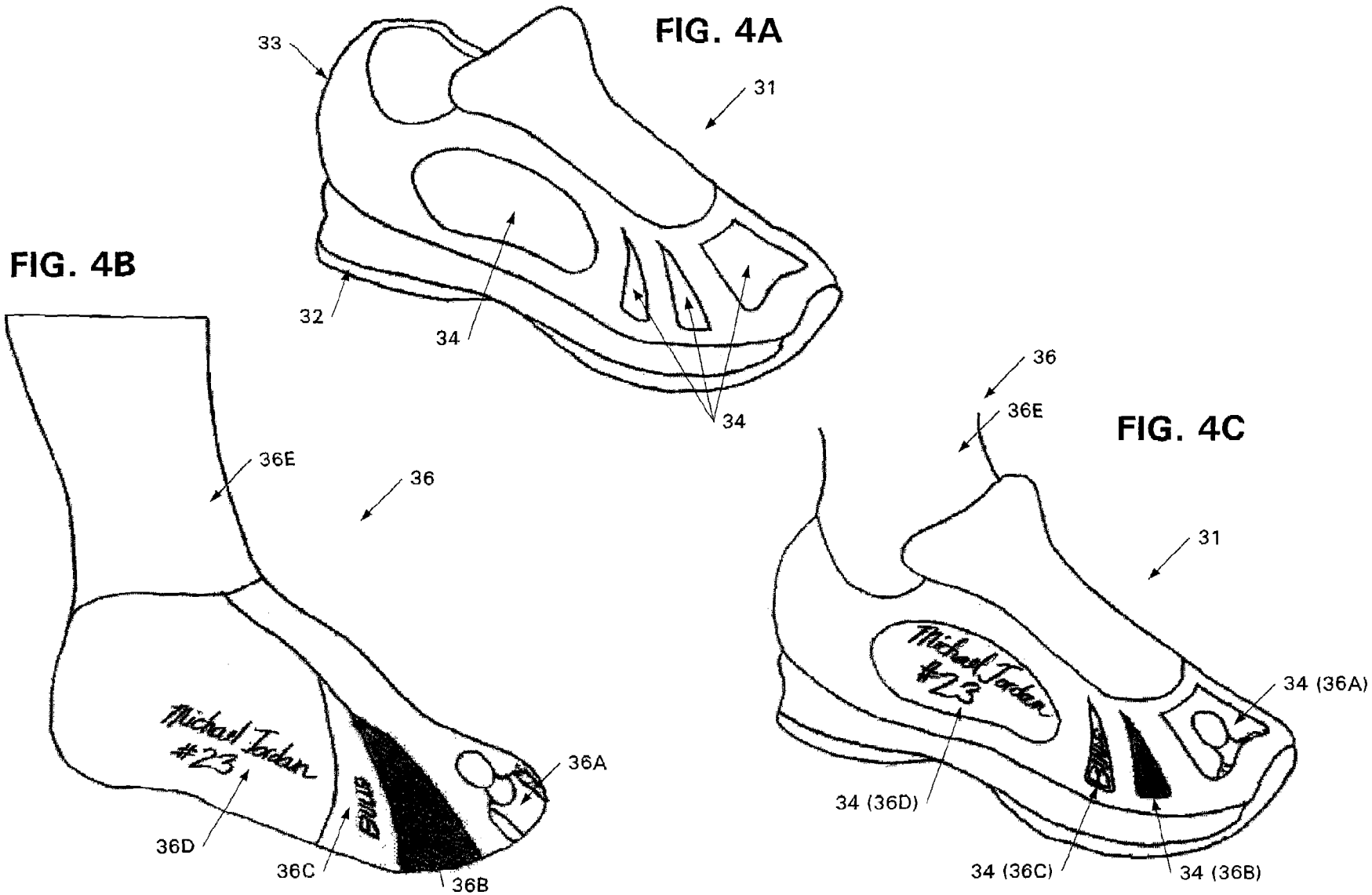
FIG. 4A is a perspective view of footwear according to a fourth embodiment of the present invention.
FIG. 4B is a perspective view of an innerliner, with multiple segments, text, and images, designed for use with the footwear of FIG. 4A according to the fourth embodiment of the present invention.
FIG. 4C is a perspective view of the combination of the footwear and innerliner of FIGS. 4A and 4B, respectively.

As described above, a specifically designed innerliner can contribute to a consumer desirable appearance by displaying various appearances through the SDA. Further development of the capabilities of this footwear system are demonstrated through the combination of innerliners with widely varied appearances, such as those containing information and indicia relating to a particular sports player, and footwear with a SDA designed to display the innerliners. For example, FIG. 4A illustrates a fourth embodiment of footwear 31 of the present invention having a sole 32 and an upper 33. The footwear 31 includes several SDAs 34 located on the sides and top of the upper 33. FIG. 4B illustrates an embodiment of an innerliner 36 with a design that includes information about a particular sports player. In this embodiment, the design includes a picture 36A of the sports player, the sports player's team colors 36B, the sports player's team name 36C (Bulls), and the sports player's name (Michael Jordan) and jersey number (#23) 36D. The ankle portion 36E of the innerliner 36 is white and looks similar to an ankle portion of a typical sock.

FIG. 4C illustrates the combination of the footwear 31 shown in FIG. 4A and the innerliner 36 shown in FIG. 4B. The combination of the innerliner 36 and the footwear 31 results in a combined appearance in which the sports player's name and number, the sports player's team name and team colors, and the picture of the sports player on the innerliner 36 are visible through the SDA 34, as shown in FIG. 4C. According to this embodiment of the present invention, other innerliners can be produced with a similar design but with information specific to other sports players so that the user of the footwear 31 shown in FIG. 4A can interchange the innerliners of the various sports players with the same pair of footwear 31.

Thus, the innerliners of the present invention can be used to change the appearance of a user's footwear so that the user has the ability to easily, rapidly and effectively change the appearance of their footwear. It is possible to create many user desirable combinations of footwear with SDA and innerliners, such that this invention provides a huge breadth of potential footwear model designs, as well as huge depth of innerliner designs that can complement a single pair of footwear with a SDA.

Design Interaction

Specific pre-determined areas of the innerliners can be displayed through specific pre-determined areas of the footwear based on the coordination of one or more of the following characteristics: the size and shape of the footwear; the layout of the SDA on the footwear; the layout, size and shape of the innerliners; the expansion and contraction characteristics of the innerliners, footwear, and SDA; and foot dimensions. The innerliners and the locations of the SDA on the footwear can be coordinated by their axes, e.g., horizontally, vertically, to facilitate an effective display of the innerliner. Furthermore, a margin of error can be built into the footwear system to account for small differences in foot size, as well as small variations in the positioning of the innerliner on the foot and within the footwear.

Figures 5A, 5B, 5C:
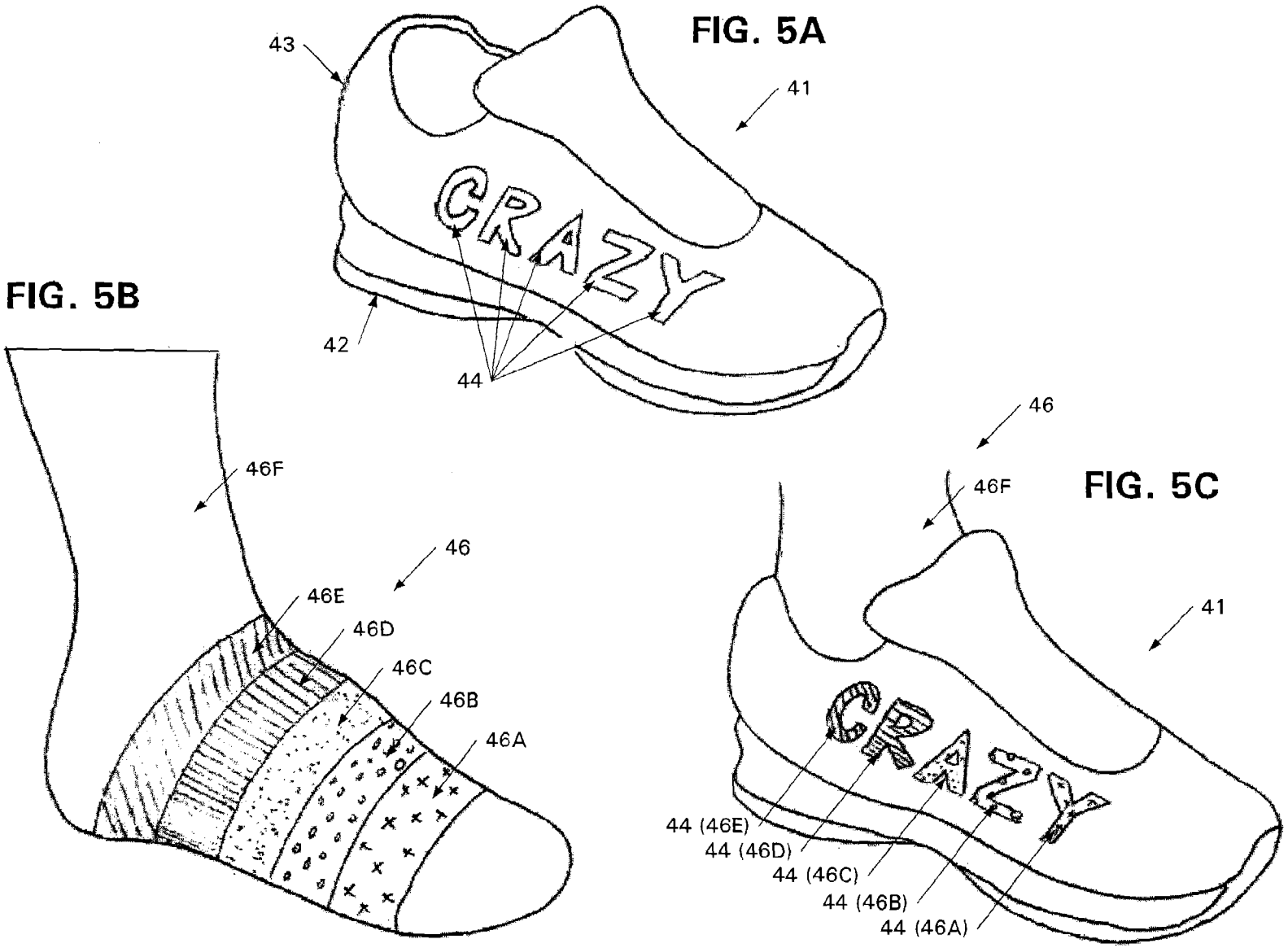
FIG. 5A is a perspective view of footwear according to a fifth embodiment of the present invention with special display areas forming text.
FIG. 5B is a perspective view of an innerliner with multiple segments of different colors designed for use with the footwear of FIG. 5A according to the fifth embodiment of the present invention.
FIG. 5C is a perspective view of the combination of the footwear and innerliner of FIGS. 5A and 5B, respectively.
Figure 5E:
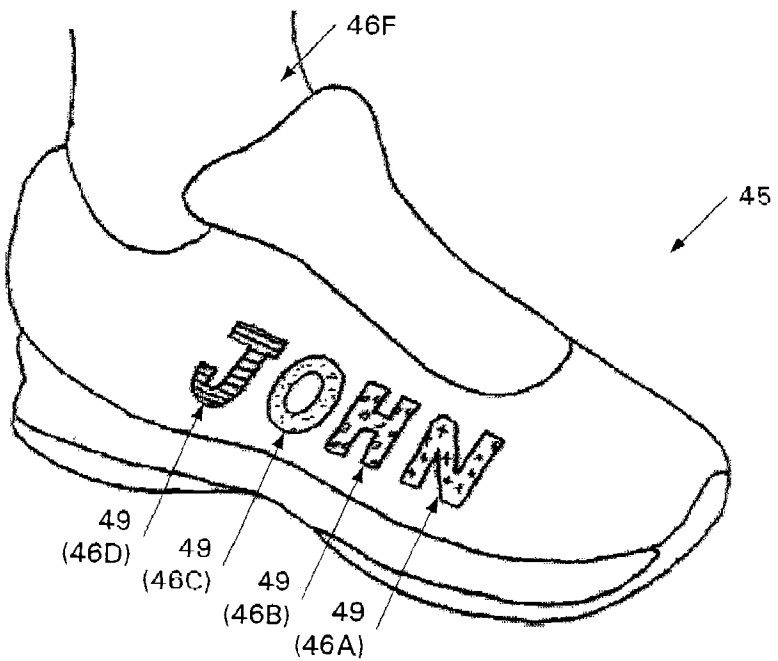
FIG. 5E is a perspective view of the combination of the footwear and innerliner of FIGS. 5D and 5B, respectively.

FIG. 5A illustrates a fifth embodiment of footwear 41 of the present invention having a sole 42 and an upper 43. The footwear 41 includes SDA 44 located on the side of the upper 43. The SDA 44 of this embodiment of the present invention are formed in the shape of the word "CRAZY."

FIG. 5B illustrates an embodiment of an innerliner 46 having multiple bands 46A, 46B, 46C, 46D, 46E of different colors. The ankle portion 46F of the innerliner 46 is white and looks similar to an ankle portion of a typical sock.

FIG. 5C illustrates the combination of the footwear 41 shown in FIG. 5A and the innerliner 46 shown in FIG. 5B. The combination of the innerliner 46 and the footwear 41 results in a combined appearance in which the multiple colored bands 46A, 46B, 46C, 46D, 46E on the innerliner 46 are visible through the SDA 44, as shown in FIG. 5C, so that each letter of the word "CRAZY" is shown in a different color according to the color band, 46A, 46B, 46C, 46D, 46E on the innerliner 46, which the letter aligns to. Other innerliners can be produced with a similar design having multiple bands of the same width as the bands of the innerliner 46 shown in FIG. 5B but with different appearances so that the user of the footwear 41 shown in FIG. 5A can interchange the innerliners with the same pair of footwear 41 to change the combined appearance. In this design, the multiple colored bands 46A, 46B, 46C, 46D, 46E are designed so that they are positioned on the innerliner 46 corresponding to predetermined positions along the length of the foot thus aligning with the letters of the SDA 44 that are formed as the word "CRAZY."

Additionally, other footwear can be produced with SDAs in the form of words, numbers objects, symbols, indicia that match up accordingly with some or all of the colored bands 46A, 46B, 46C, 46D, 46E of the innerliner 46 shown in FIG. 5A.

Figure 5D:
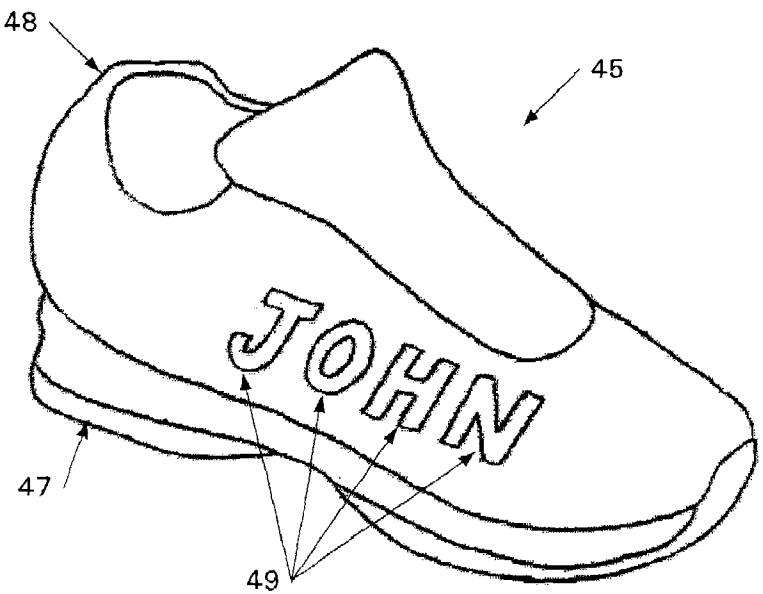
FIG. 5D is a perspective view of footwear designed for use with the innerliner of FIG. 5B according to the fifth embodiment of the present invention.

FIG. 5D illustrates footwear 45 of the present invention having a sole 47 and an upper 48. The footwear 45 includes SDAs 49 located on the side of the upper 48. The SDAs 49 of this embodiment of the present invention are formed in the shape of the word "JOHN" so that four of the colored segments 46A, 46B, 46C, 46D on the innerliner 46 align with the four letters of the SDA 49: J, O, H, and N, respectively. Thus, a single innerliner can be designed to provide a consumer desirable combined appearance with multiple lines of footwear, and multiple lines of footwear can be designed to each provide a different consumer desirable combined appearance in conjunction with a single design of the innerliner.

The SDA on the footwear can cover a small area, a medium-sized area, or almost the entire upper of the footwear. The innerliners can incorporate visual attributes that cover a small area, a medium-sized area, or the entire area of the innerliner.

Figure 6A:
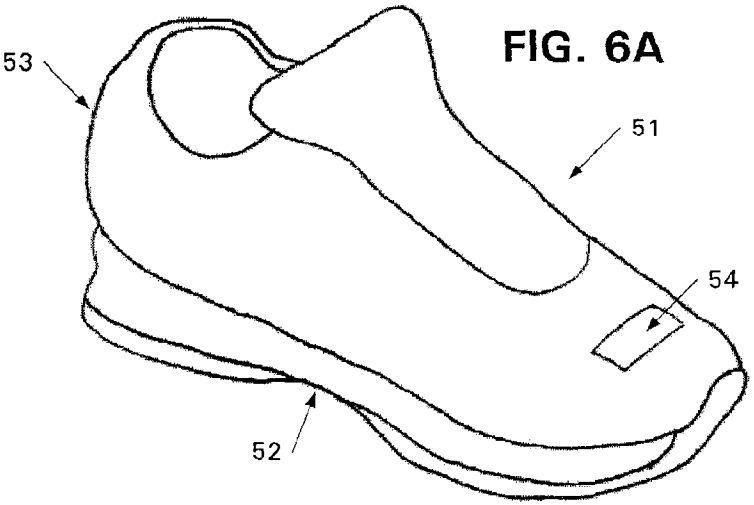
FIG. 6A is a perspective view of footwear according to a sixth embodiment of the present invention with a single small special display area.

FIG. 6A illustrates a sixth embodiment of footwear 51 of the present invention having a sole 52 and an upper 53. The footwear 51 includes a single SDA 54 that covers a small portion of the upper 53. In this embodiment of the invention, the non-SDA portions of the footwear 51 occupy more area on the upper 53 than the SDA 54.

Figure 6B:
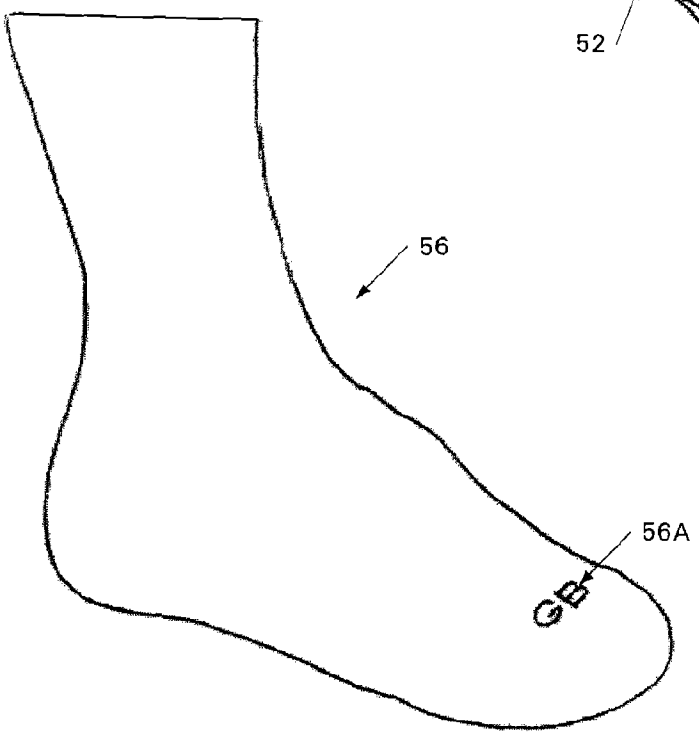
FIG. 6B is a perspective view of an innerliner with text, which is designed for use with the footwear of FIG. 6A according to the sixth embodiment of the present invention.

FIG. 6B illustrates an embodiment of an innerliner 56 with a single attribute. In this embodiment, the design of the innerliner 56 includes a small design 56A, e.g., the logo "GB."

Figure 6C:
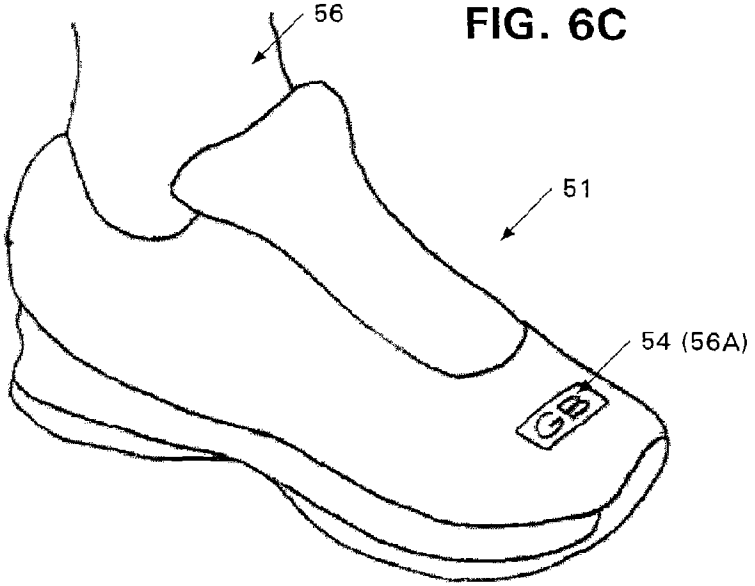
FIG. 6C is a perspective view of the combination of the footwear and innerliner of FIGS. 6A and 6B, respectively.

FIG. 6C illustrates the combination of the footwear 51 shown in FIG. 6A and the innerliner 56 shown in FIG. 6B. The combination of the innerliner 56 and the footwear 51 results in a combined appearance that includes the letters "GB" 56A on the innerliner 56 being visible through the single SDA 54, as shown in FIG. 6C. The SDA 54 in this embodiment is small and therefore the position of the innerliner in relation to SDA can be very important in achieving the intended combined appearance.

A specific combined appearance can be created by integrating the layout, materials, and appearance of the innerliners; the layout, materials, and appearance of the SDA; and the layout, materials, and appearance of the non-SDA portion of the footwear. A large number of combined appearances can be created by coordinating one or more of the above-described characteristics.

For example, one or more flowers can be designed on the footwear by using SDAs for the petals of the flower and non-SDA portions for other flowers. Various innerliners can be interchanged to alter the appearance, e.g. color of the petals of the SDA flowers on the footwear. The combined appearance integrates the SDA flowers, other SDAs, innerliner, non-SDA flowers and other non-SDA portions of the footwear.

Figures 7A, 7B, 7C:
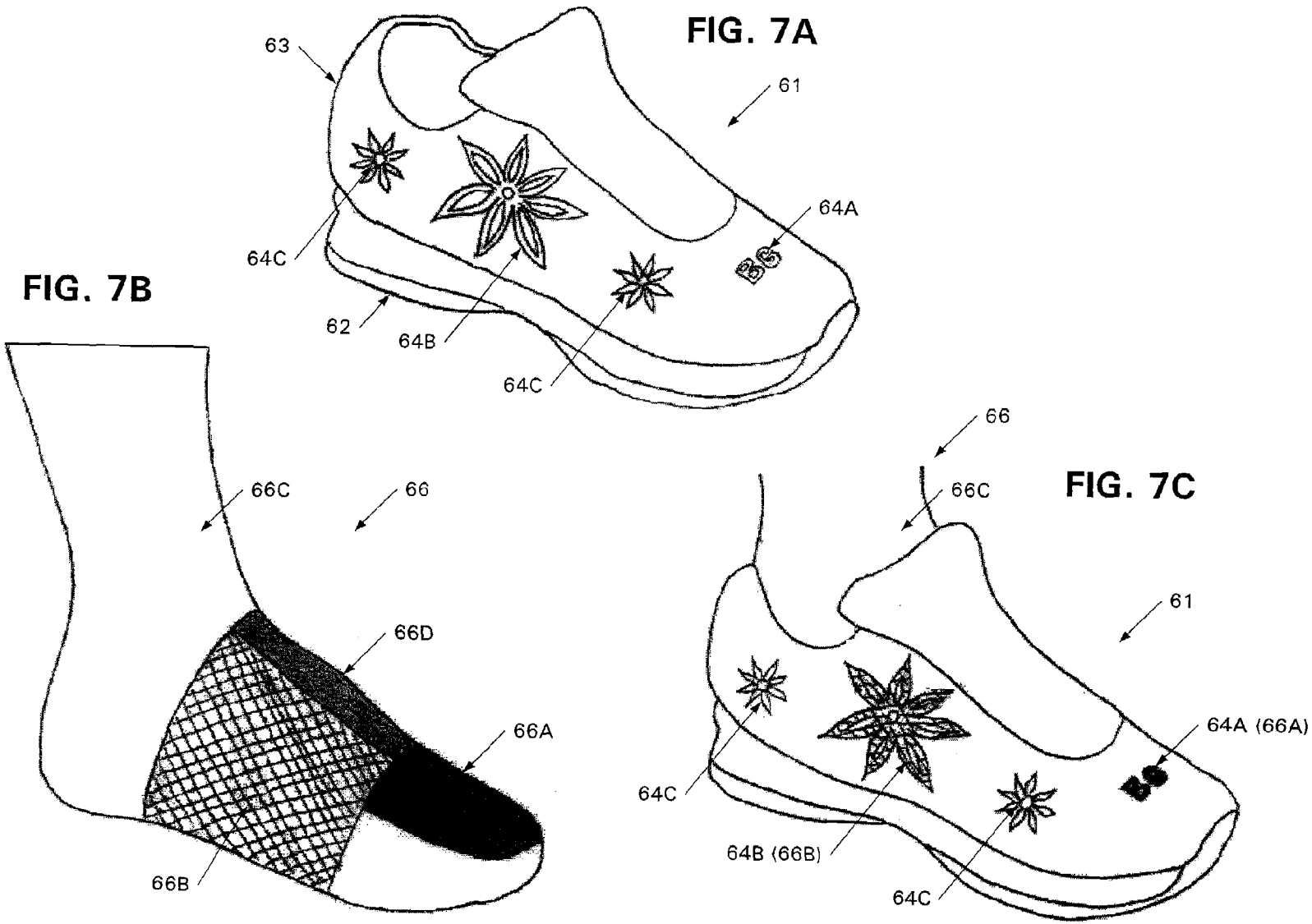
FIG. 7A is a perspective view of footwear according to a seventh embodiment of the present invention wherein the footwear has designs and text.
FIG. 7B is a perspective view of a multiple section, multiple color innerliner designed for use with the footwear of FIG. 7A according to the seventh embodiment of the present invention.
FIG. 7C is a perspective view of the combination of the footwear and innerliner of FIGS. 7A and 7B, respectively.

FIG. 7A illustrates a seventh embodiment of footwear 61 of the present invention having a sole 62 and an upper 63. The footwear 61 includes a SDA 64A that is shaped in the logo of the shoe manufacturer (BG) and another SDA 64B that is shaped as a flower with petals located on the side of the upper 63. The footwear 61 also includes designs of flowers 64C which are not SDA with the color of the petals of the non-SDA flowers not changeable by interchanging the innerliners.

FIG. 7B illustrates an innerliner 66 with one colored portion 66A that is designed to be positioned under the SDA 64A that is shaped as the logo, another colored portion 66B that is designed to be positioned under the SDA 64B shaped as the flower, and a third colored portion 66D. The third colored portion 66D wraps around the non-visible side of the innerliner 66 and would be visible through a SDA if there were a SDA aligned with the third colored portion 66D on the non-visible side of footwear 61. If there were no SDAs on the non-visible side of footwear 61 that aligns with colored portion 66D, then colored portion 66D would not be visible through a SDA on the non-visible side of the footwear 61. The ankle portion 66C of the innerliner 66 is white and looks similar to an ankle portion of a typical sock.

FIG. 7C illustrates the combination of the footwear 61 shown in FIG. 7A and the innerliner 66 shown in FIG. 7B. The combination of the innerliner 66 and the footwear 61 result in a combined appearance in which the color of the colored portion 66B on the innerliner 66 positioned below the flower-shaped SDA 64B is visible through the flower-shaped SDA 64B, as shown in FIG. 7C. This combination also shows the logo-shaped SDA 64A having the color printed on the colored portion 66A of the innerliner 66 positioned below the logo-shaped SDA 64A. Thus, this footwear 61 can be worn with colored innerliners 66 to provide a combined appearance that includes a flower on the footwear 61 with colored petals depending on the innerliners 66 chosen by the user. Colored portion 66D of the innerliner 66 is not visible from the perspective provided.

Furthermore, it is also possible for a single pair of innerliners to provide two combined appearances for a single pair of footwear based on the appearance of each side of the innerliner, the layout/existence of SDAs on each side of the footwear, and which foot of the footwear, i.e., left or right, the innerliner is placed.

Figure 7E:
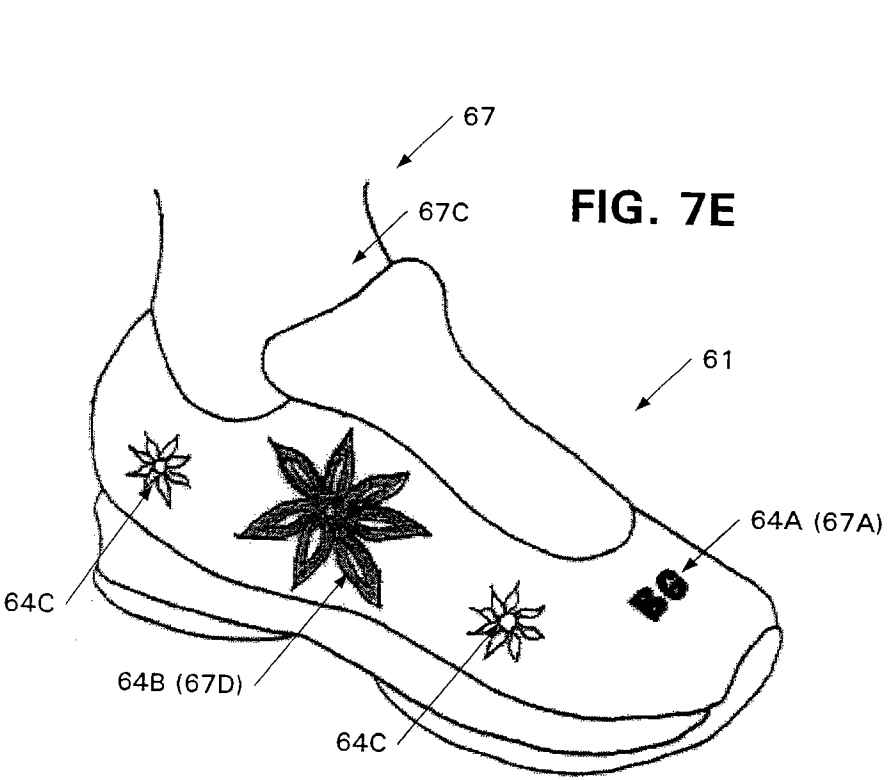
FIG. 7E is a perspective view of the combination of the footwear and innerliner of FIGS. 7A and 7D, respectively.
Figure 7D:
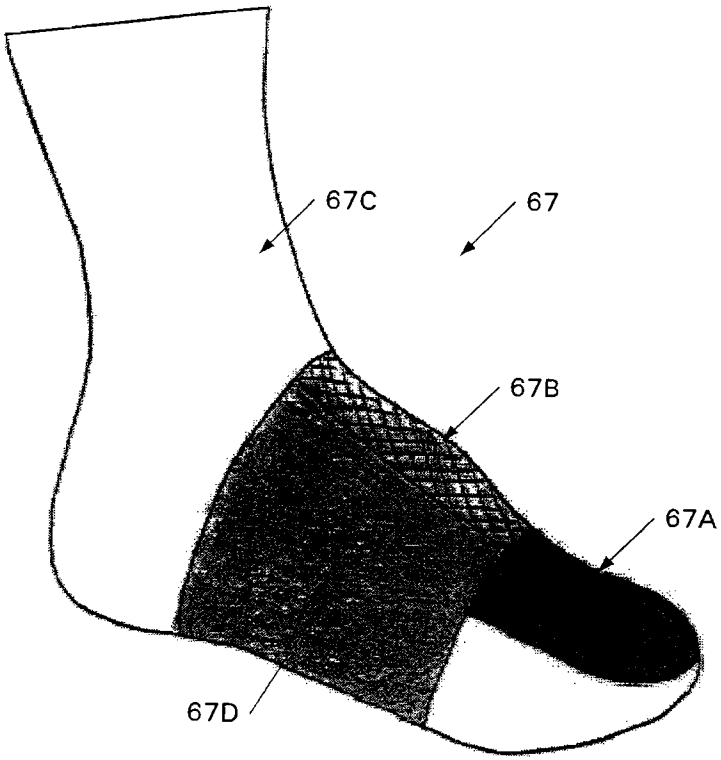
FIG. 7D is a perspective view of a multiple section, multiple color innerliner designed for use with the footwear of FIG. 7A according to the seventh embodiment of the present invention.

FIG. 7D illustrates an innerliner 67 with one colored portion 67A that is designed to be positioned under the SDA 64A shaped as the logo, another colored portion 67D that is designed to be positioned under the SDA 64B shaped as the flower and a third colored portion 67B. The colored portion 67B wraps around the non-visible side of the innerliner and would be visible through an SDA, if there were an SDA aligned with the colored portion 67B on the non-visible side of footwear 61. If there were no SDA on the non-visible side of footwear 61 that aligns with colored portion 67B, then colored portion 67B would not be visible. The ankle portion 67C of the innerliner 67 is white and looks similar to an ankle portion of a typical sock. It is to be understood that innerliner 67 represents the inverse of innerliner 66 and that innerliners 66 and 67 could represent a pair of innerliners that are worn together.

FIG. 7E illustrates the combination of the footwear 61 shown in FIG. 7A and the innerliner 67 shown in FIG. 7D. The combination of the innerliner 67 and the footwear 61 results in a combined appearance in which the colored portion 67D on the innerliner 67 positioned below the flower-shaped SDA 64B is visible through the flower-shaped SDA 64B, as shown in FIG. 7E. This combination also shows the logo-shaped SDA 64A having the color printed on the colored portion 67A of the innerliner 67 positioned below the logo-shaped SDA 64A. Colored portion 67B of the innerliner 67 is not visible from the perspective provided.

Thus, with the footwear 61 and the pair of innerliners 66 and 67, the user has the capability to produce two combined appearances from just one pair of innerliners 66 and 67 by switching the foot on which the innerliner 66 or 67 is used with the footwear 61, i.e., from left to right, and vice versa.

For example, if footwear 61 shown in FIG. 7A is the right shoe of a pair of footwear, and a user places innerliner 66 on his right foot and then puts his innerliner-covered foot into footwear 61, it would produce one combined appearance. If the user then removes his innerliner-covered foot from footwear 61, removes innerliner 66 from his right foot, places innerliner 67 on his right foot, and then replaces his innerliner-covered foot into footwear 61, it would produce a second combined appearance. It is to be understood in this example that the left shoe (not shown), would form a pair of footwear, in combination with footwear 61 shown in FIG. 7A. When a foot covered with innerliner 66 is placed in the right shoe 61, then innerliner 67 could be worn on the left foot and thus create a combined appearance with the left shoe. This left shoe may have the same, the inverse, or a different layout of SDA, as well as having the same or different type and/or design SDA, as compared to footwear 61. Thus, a pair of innerliners may produce the same, the inverse, or a different combined appearance with each shoe of the footwear and the same, the inverse, or a different combined appearance for the right shoe as compared to the left shoe of a pair of footwear.

Thus, it is possible for a single pair of innerliners to create two combined appearances for each shoe in a pair of footwear with SDAs. Additional methods for multiplying the combined appearances possible with a single pair of innerliners include turning the innerliner inside out (reversing) or rotating the innerliner on the foot. Reversible innerliners can be designed to provide a different combined appearance by turning the innerliner inside out. The reversible innerliners include an inner or inside surface and an outer or outside surface. Thus, a user changes the combined appearance of the footwear by removing their footwear, turning the innerliners inside out, such that area formally facing the foot is now facing outward toward the footwear and display areas, and then replacing the innerliner covered feet into the footwear.

Another embodiment involves the innerliners being adapted to provide a different combined appearance by rotating the innerliner on the foot. Users can change the combined appearance of the footwear by removing the footwear, turning the innerliners, e.g. 90 or 180 degrees and replacing them in the footwear. Each of these components of the innerliner system multiply the number of potential combined appearances that are possible from one pair of innerliners and provide the user with the ability to alter the appearance of their footwear when an additional pair of innerliners is not readily available, such as when traveling from a work setting to a more casual atmosphere.

SDA Effect/Interaction with Innerliner

A large number of different optical and visual effects and/or appearances can be created by coordinating the appearance, design and materials of the SDA and the appearance, design and materials of the innerliners. The SDA of the present invention can display, interact with and/or affect the appearance of the innerliners.

Significant improvements in the quality of the combined appearance resulting from the combination of the innerliner and the SDA, as well as increased design options can be achieved by incorporating various materials, structures and designs into the SDA, such that rather than just displaying the innerliner, the SDA interacts with and/or affects the appearance of the innerliner, thus impacting the result of the combination of the innerliner and SDA. One method to accomplish such an effect is to include a semitransparent color tinted material in the SDA, such as the tinted acrylic sold by A&C Plastics, Inc., or tinted polyvinyl chloride sold by Wiman Corp. For example, if a yellow SDA covers a green portion of the innerliner it would create a blue appearance when viewed from outside of the footwear.

FIGS. 8A-8G illustrate combinations of footwear and innerliners of the present invention in which the color of the innerliner appears to change to a different color when viewed through a colored SDA. The color of the innerliner, the SDA (if applicable), and the color appearing through the SDA as it overlaps the innerliner are indicated on the figures (FIGS. 8A-8G) and described below.

Figure 8A:
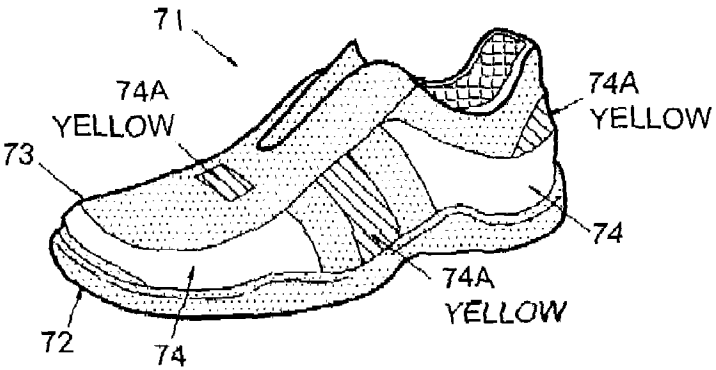
FIG. 8A is a perspective view of footwear according to an eighth embodiment of the present invention with colored special display areas.

FIG. 8A illustrates an eighth embodiment of footwear 71 of the present invention having a sole 72 and an upper 73. The footwear 71 includes several colorless SDAs 74 located at various positions on the upper 73 and multiple yellow SDAs 74A that are shaped as stripes on the top, sides, and rear of the footwear 71. In this illustration of the invention, most of the non-SDA portions of the footwear 71 are black.

Figure 8B:
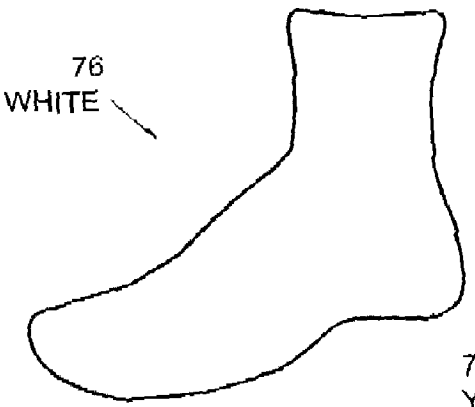
FIG. 8B is a perspective view of an innerliner designed for use with the footwear of FIG. 8A according to the eighth embodiment of the present invention.
Figure 8C:
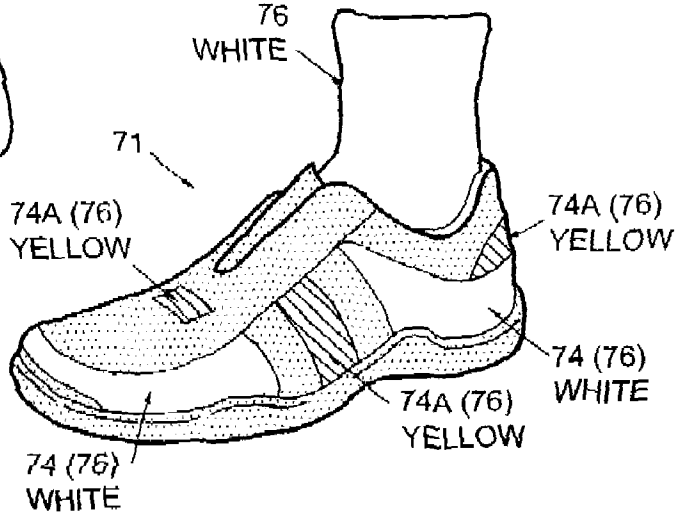
FIG. 8C is a perspective view of the combination of the footwear and innerliner of FIGS. 8A and 8B, respectively.

FIG. 8B illustrates an innerliner 76, which is entirely in white. FIG. 8C illustrates the combination of the footwear 71 shown in FIG. 8A and the innerliner 76 shown in FIG. 8B. The combination of the innerliner 76 and the footwear 71 results in a combined appearance that includes a yellow stripes when the yellow SDAs 74A on the top and sides of the footwear 71 display the white innerliner 76, as shown in FIG. 8C. The areas where the transparent SDAs 74 cover the white innerliner 76, appear white.

Figure 8E:
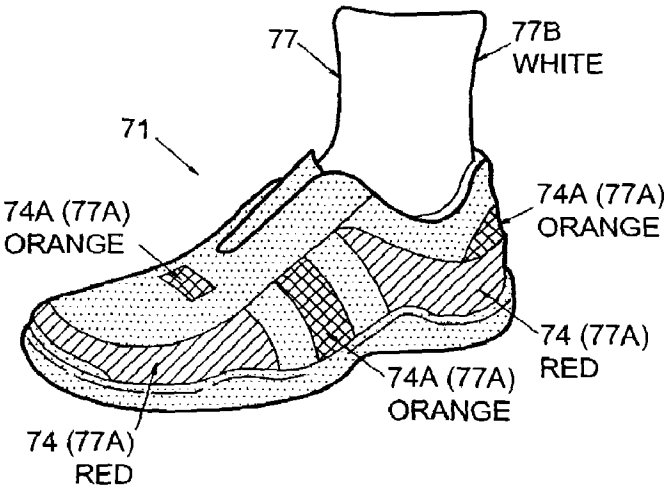
FIG. 8E is a perspective view of the combination of the footwear and innerliner of FIGS. 8A and 8D, respectively.
Figure 8G:
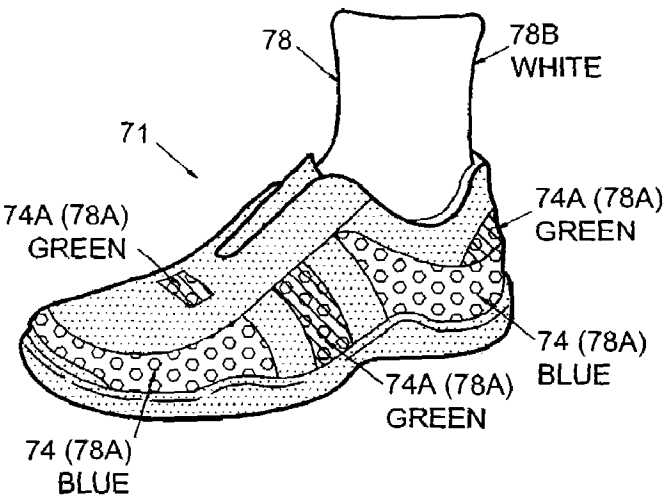
FIG. 8G is a perspective view of the combination of the footwear and innerliner of FIGS. 8A and 8F, respectively.
Figure 8D:
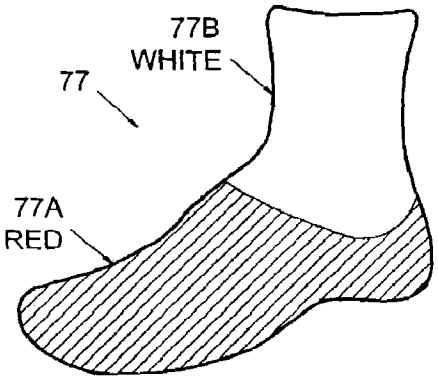
FIG. 8D is a perspective view of a two color innerliner designed for use with the footwear of FIG. 8A according to the eighth embodiment of the present invention wherein the innerliner and display area colors interact to produce the color orange.

FIG. 8D illustrates another version of an innerliner 77 of the eighth embodiment of the present invention which has a red bottom portion 77A and a white ankle portion 77B. FIG. 8E illustrates the combination of the footwear 71 shown in FIG. 8A and the innerliner 77 shown in FIG. 8D. The combination of the innerliner 77 and the footwear 71 results in a combined appearance that includes orange stripes when the yellow SDAs 74A on the top and sides of the footwear 71 display the red bottom portion 77A of the innerliner 77, as shown in FIG. 8E. The areas where the transparent SDAs 74 display the red bottom portion 77A of innerliner 77 appear red.

Figure 8F:
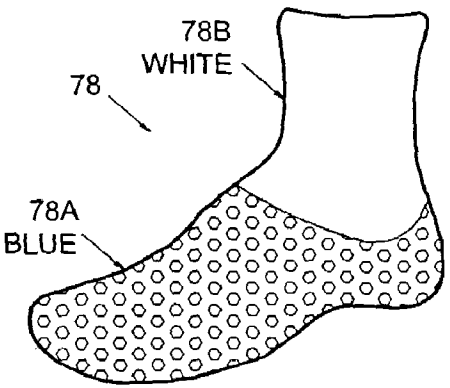
FIG. 8F is a perspective view of a two color innerliner designed for use with the footwear of FIG. 8A according to the eighth embodiment of the present invention wherein the innerliner and display area colors interact to produce the color green.

FIG. 8F illustrates an innerliner 78, which has a blue bottom portion 78A and a white ankle portion 78B. FIG. 8G illustrates the combination of the footwear 71 shown in FIG. 8A and the innerliner 78 shown in FIG. 8F. The combination of the innerliner 78 and the footwear 71 results in a combined appearance that includes green stripes when the yellow SDAs 74A on the top and sides of the footwear 71 display the blue bottom portion 78A of the innerliner 78, as shown in FIG. 8G. The areas where the transparent SDAs 74 display the blue bottom portion 78A of the innerliner 78 appear blue.

Another effect is provided through the interaction of the innerliner and SDA which occurs when the appearance of the innerliner emanates from within the SDA or the outside surface of the SDA. Through this interaction, the SDA can take on some of the user desirable attributes of the innerliner. This optical effect occurs by using various optical devices and materials in the SDA including e.g. a lens that bends light, a prism that breaks light apart, and mirrors that reflect or redirect light. Optical effects identified that create emanation include reflection, refraction, suffusion, diffusion, diffraction, deflection and dispersion. These optical effects can created in various ways. One example is to align double sided mirrors at 45 degree angles, overlapping by half their length. Again the light appears to originate from the location from which its direction was last changed, thus the appearance, e.g. color of the innerliner would emanate or appear to originate from the SDA. Another method for achieving these effects includes putting a finish, e.g. matte, microsheen, taffeta or suede on a transparent material, such that the finish deflects, redirects or diffuses a portion of the light from the innerliner back to the observer's eye. A third method for achieving this effect is to include small lenses within a transparent material, such that the lenses redirect, concentrate and dissipate the light, such that the light appears to originate from the location from which its direction was changed, rather than the innerliner from which it was reflected. The emanation effect can be enhanced by incorporating various materials into the SDA and innerliner and/or coordinating the materials of the SDA with the materials of the innerliners. Effective innerliner materials include materials that are reflective, such as 3M™ Scotchlite™ or materials that have are fine threads, thus minimizing the space between the SDA and innerliner.

The spatial relationship of the innerliner and SDA is important, because space between the innerliner and SDA can cause some light to bounce off the inside surface of the SDA, thus preventing it from being transmitted to an observer's eye, and limiting or eliminating the ability to create emanation. The SDA is also important since the finish on the inner facing side has limited reflective qualities, that the material be supple enough to conform to the foot and innerliner and that the SDA material and structure results in the desired optical effect in coordination with the innerliner material.

Figure 9A:
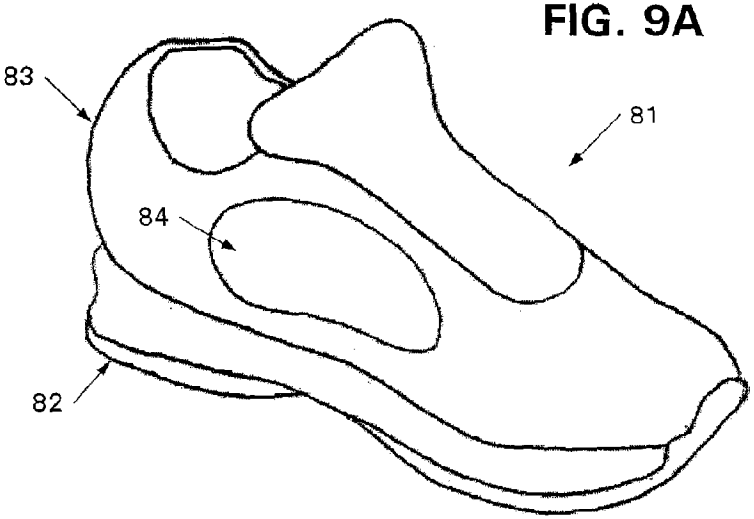
FIG. 9A is a perspective view of footwear according to a ninth embodiment of the present invention in which some of the appearance of the innerliner emanates from the SDA.

FIG. 9A illustrates a ninth embodiment of footwear 81 of the present invention having a sole 82 and an upper 83. The footwear 81 includes a SDA 84 that incorporates light diffusing materials, such as LEXAN, Mylar, DynaGlas Plus LDT, Bayer's Makrolon® or De-lite specialized coatings, located on the side of the upper 83.

Figure 9B:
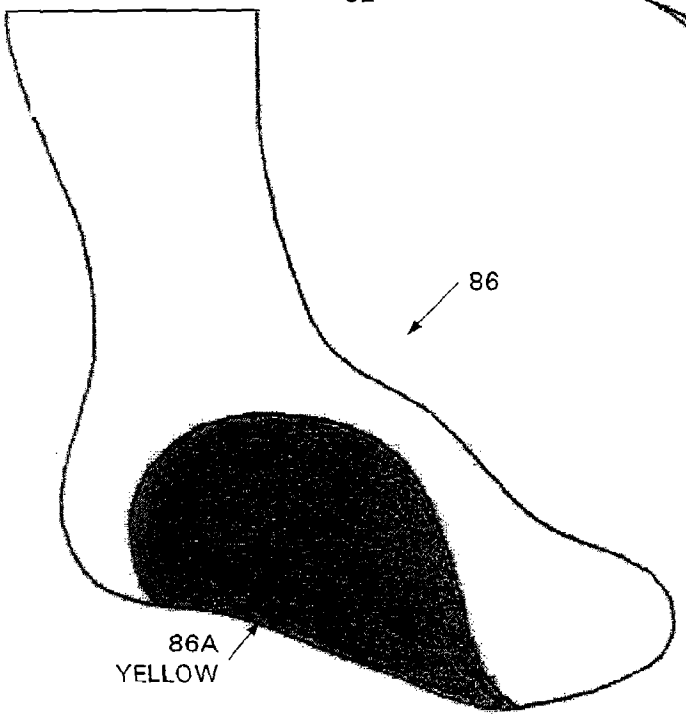
FIG. 9B is a perspective view of an innerliner designed for use with the footwear of FIG. 9A according to the ninth embodiment of the present invention.
Figure 9C:
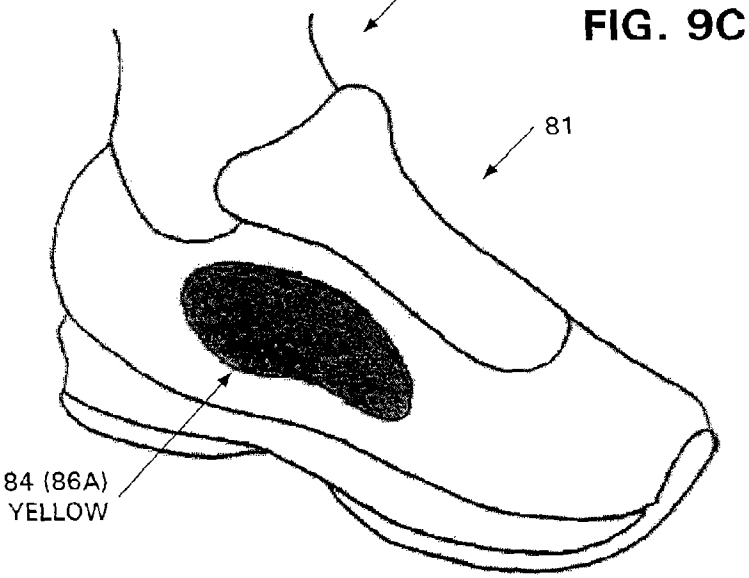
FIG. 9C is a perspective view of the combination of the footwear and innerliner of FIGS. 9A and 9B, respectively.

FIG. 9B illustrates an innerliner 86 with an area positioned under the SDA 84 on the side of the footwear 81 that includes an area 86A of flat color, e.g., yellow. FIG. 9C illustrates the combination of the footwear 81 shown in FIG. 9A and the innerliner 86 shown in FIG. 9B. The combination of the innerliner 86 and the footwear 81 results in a combined appearance that includes the innerliner 86 positioned under the SDA 84 so that light is diffused by the SDA 84, some light is reflected off colored area 86A and is again diffused by the SDA 84 before exiting the SDA 84. The effect of the diffusion is that some of the colors of light that are not absorbed by the colored area 86A emanate from within or from the surface of the SDA 84 and not from the innerliner underneath the SDA 84. This effect is consumer desirable as it provides many additional combined appearances, and it allows for the use of an innerliner to alter the appearance of footwear with an SDA in a manner such that through the observation of the end result, one may not be able to tell that an innerliner is used to contribute to the appearance of the footwear and instead provides the impression of a seamless unit.

Figure 10A:
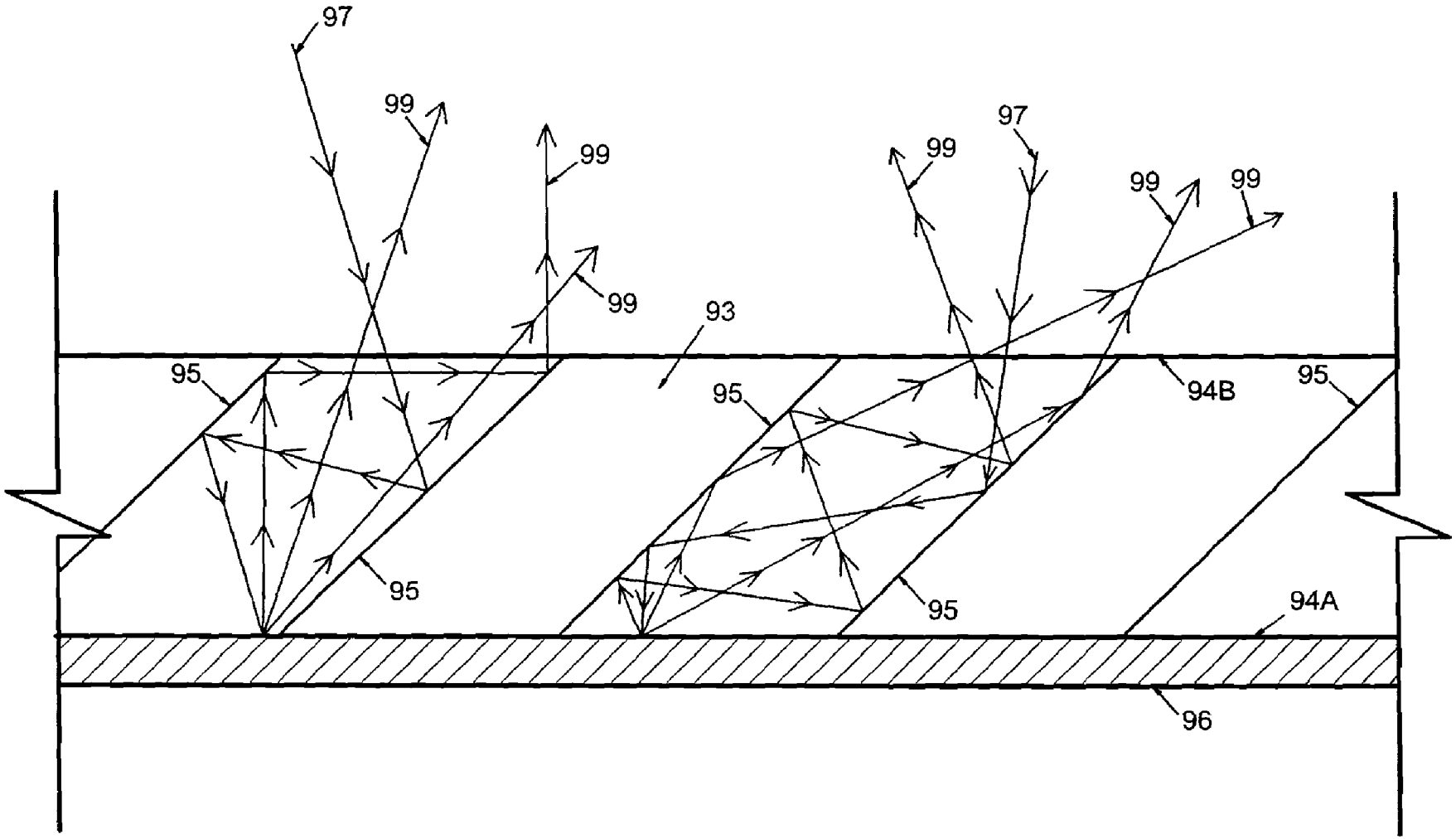
FIG. 10A is a cross-sectional view of the combination of a SDA and innerliner according to a tenth embodiment of the present invention, in which a SDA with mirrors effects, and/or interacts with, the innerliner to cause emanation.

As stated above, various materials, structures, and techniques can be used to accomplish the effect of having the appearance, e.g., color, of the innerliner emanate from within or from the exterior surface of the SDA, versus when the SDA simply displays the innerliner. A technique utilizing reflection via mirrors to accomplish this emanation effect is shown in FIG. 10A. FIG. 10A illustrates a sectional view of the combination of a SDA 93 of footwear overlying an innerliner 96 according to a tenth embodiment of the present invention. The SDA 93 includes an interior surface 94A that is positioned flush against the exterior surface of the innerliner 96 and an exterior surface 94B. Double-sided mirrors 95 are each positioned at 45° angles with respect to the interior and exterior surfaces 94A and 94B of the SDA 93. The double-sided mirrors 95 are lined up so that the bottom of each mirror aligns vertically with the top of the next mirror. External light 97 can be reflected off and between the mirrors 95 to the outer surface of the innerliner 96 or the external light 97 can reach the innerliner 96 directly (not shown). Light 99 that is not absorbed by the innerliner 96 is then mostly reflected back to and between the mirrors 95 before exiting the SDA 93. Thus, since a majority of the reflected light 99 that exits from the SDA 93 reflects off the innerliner 96 and off at least one mirror 95, a majority of the light and, thus the reflected visual attributes of the innerliner 96, emanate from the mirrors 95 within the SDA 93. A majority of the visible attributes of the innerliner 96, e.g. color, emanate from the SDA 93. Also, there may be variations in appearance of the combined innerliner and SDA as a result of the 45° angle of the mirrors, the various angles that light enters the SDA, the way the light reflects off of the innerliner and/or the mirrors, and the angle from which the SDA is observed.

Figure 10B:
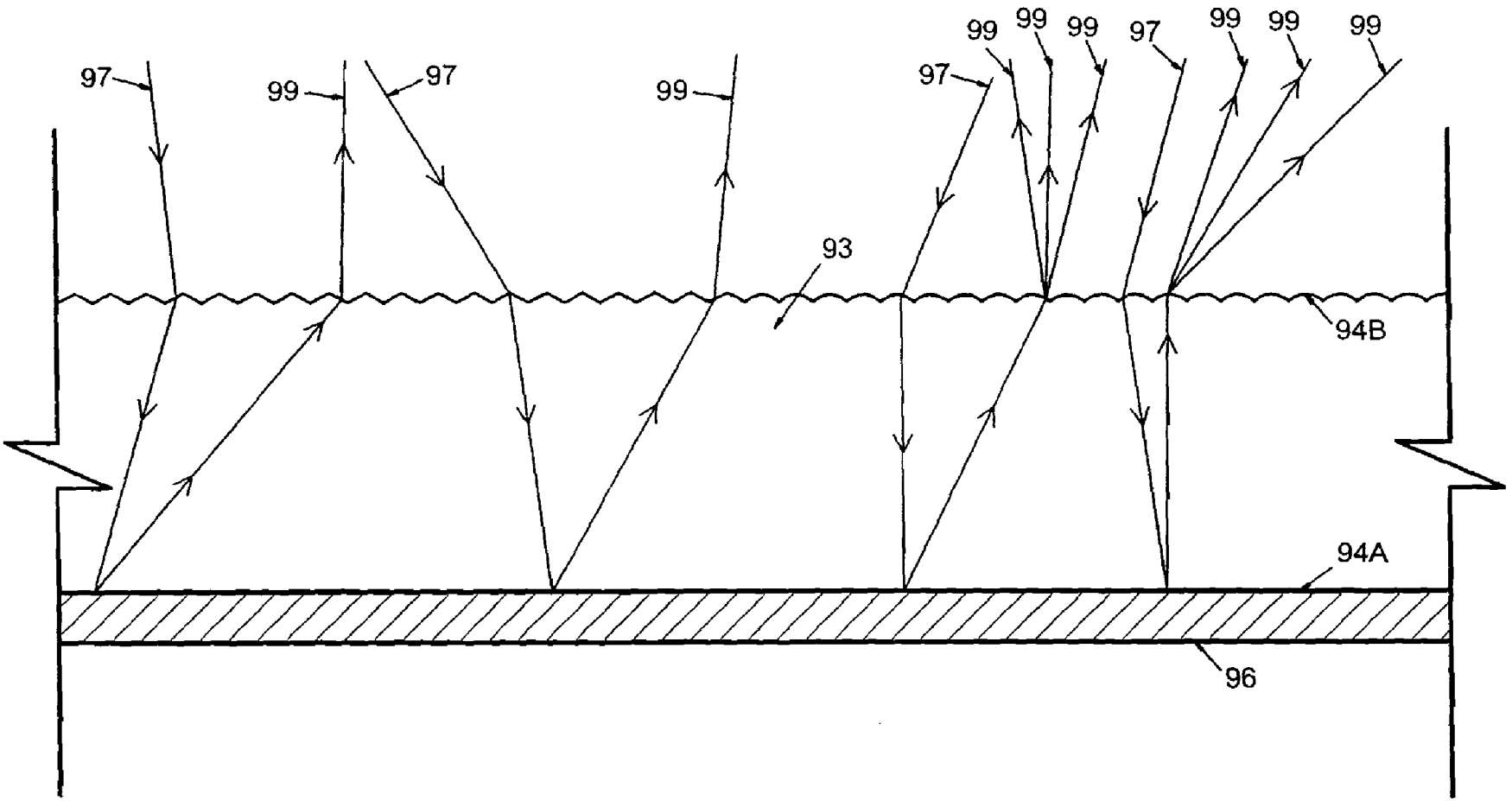
FIG. 10B is a cross-sectional view of the combination of a SDA and innerliner also according to a tenth embodiment of the present invention, in which a SDA with a surface treatment effects and/or interacts with the innerliner to cause emanation.
Figure 10C:
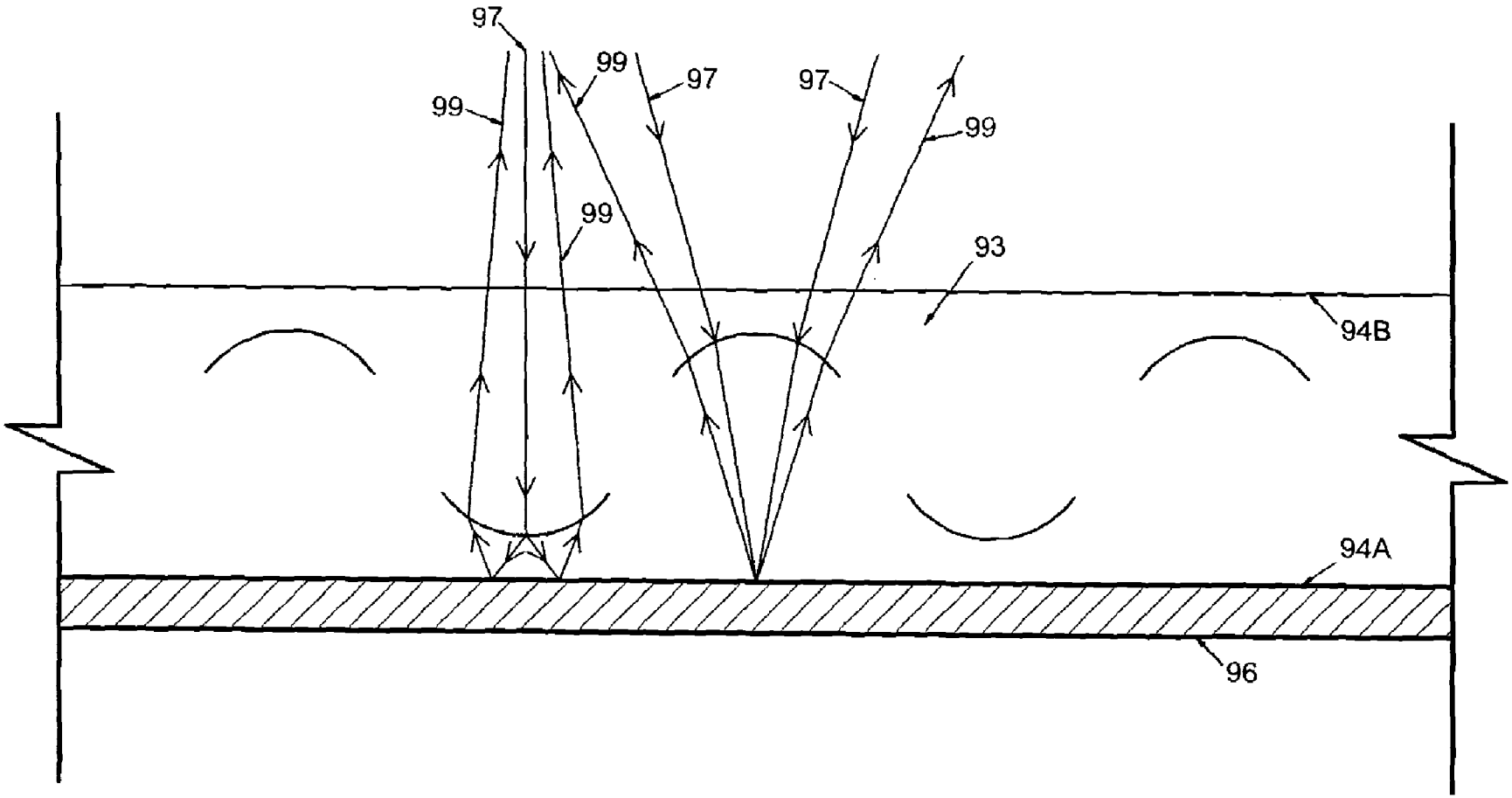
FIG. 10C is a cross-sectional view of the combination of a SDA and innerliner according to a tenth embodiment of the present invention in which a SDA with lenses effects and/or interacts with the innerliner to cause emanation.

Another technique, utilizing a surface finish to accomplish the emanation effect, is shown in FIG. 10B. In this example, the left side of the SDA has a surface treatment that results in the deflection or redirection of light traveling in either direction, whereas the right side of the has a surface treatment that results in the diffusion of light as it departs the SDA. A third technique utilizing imbedded lenses to accomplish the effect is shown in FIG. 10C. In this example light rays traveling through the convex lens causes the light to converge and light traveling through the concave lens is refracted. The resulting appearance includes the magnification or shrinking of certain aspects of the appearance of the innerliner, and that some of the visual attributes of the innerliner would appear to emanate from the SDA.

Another optical effect of the SDA occurs when the SDA acts as a filter to display hidden attributes on the innerliner. The footwear includes a SDA that includes transparent and semitransparent pigments, often finely ground, such as those sold by Hongment Chemicals Limited, Oxen's Pearl Lustre Pigments, which absorb certain colors of light, thus changing the colors of light that are available to be reflected off of the innerliner, and thus changing the appearance of the innerliner when it is displayed through the SDA.

Figures 11A, 11B, 11C:
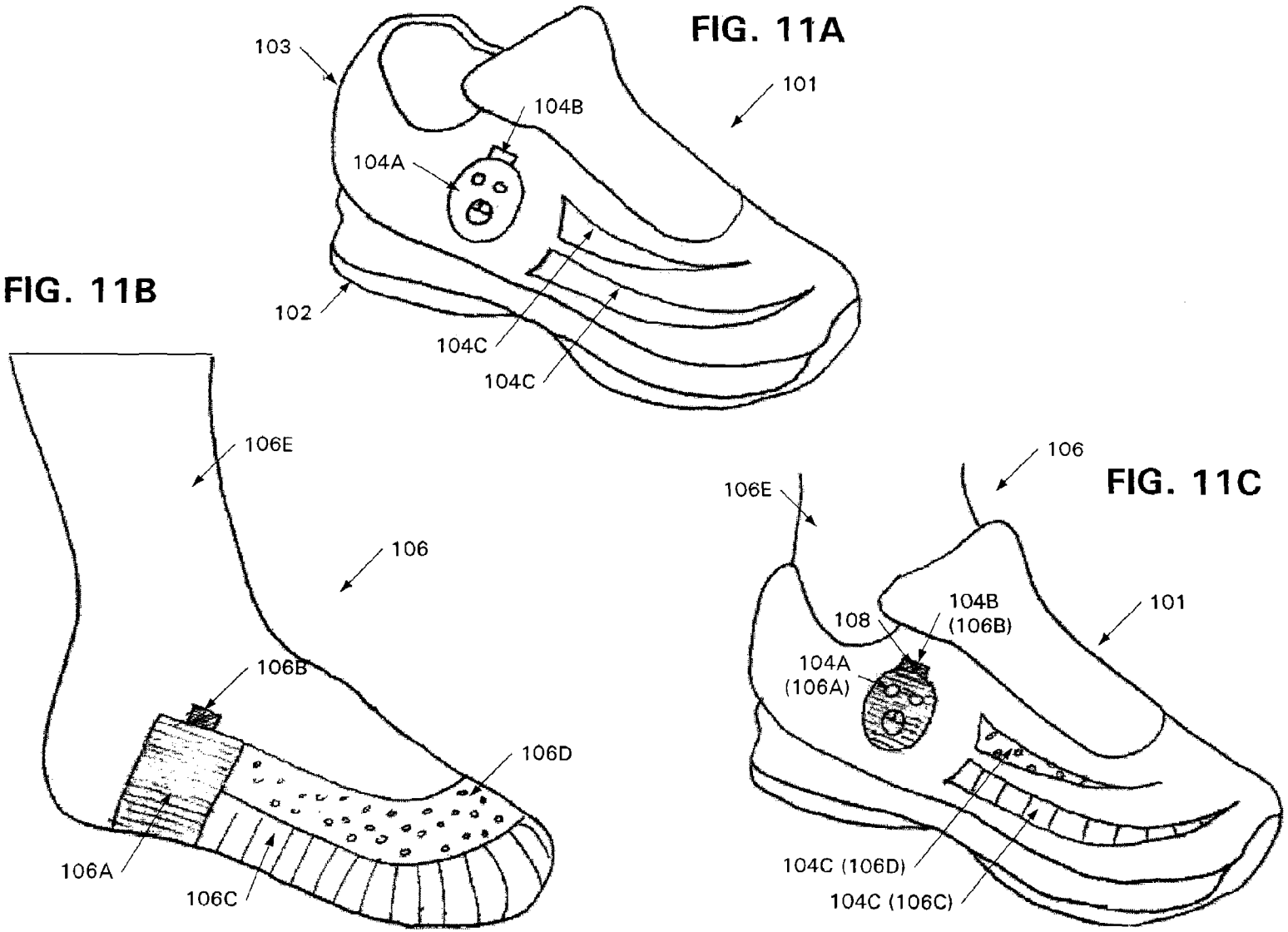
FIG. 11A is a perspective view of footwear according to an eleventh embodiment of the present invention with an image shaped SDA on the shoe that is coordinated with the innerliner.
FIG. 11B is a perspective view of a multiple color, multiple section innerliner designed for use with the footwear of FIG. 11A according to the eleventh embodiment of the present invention.
FIG. 11C is a perspective view of the combination of the footwear and innerliner of FIGS. 11A and 11B, respectively.

FIG. 11A illustrates an eleventh embodiment of footwear 101 of the present invention having a sole 102 and an upper 103. The footwear 101 includes a SDA 104A located on the side of the upper 103 that is formed in the shape of a face of a children's television character, e.g., a Teletubby, and a color-filtering SDA 104B that is impregnated with transparent or semitransparent pigments, which act to absorb and thus filter out various colors of light. The SDA 104A is formed as a three-dimensional Teletubby whose surface is textured to enhance its appearance. In this example, the SDA 104A provides both the shape and the texture of an image whereas the innerliner only provides the color. SDA 104B illustrates the potential of the SDA to filter certain colors of light, to modify the appearance of the innerliner, and to display otherwise hidden or unapparent aspects of the innerliner. If, for example, a green display or design on an innerliner were interspersed with indigo and violet colored fibers or dye, the colors indigo and violet would act to obscure the clarity of the green display or design. When the innerliner was placed behind a SDA impregnated with transparent or semitransparent pigments that absorb indigo and violet, the green display or design would become more apparent when the innerliner is viewed through the SDA. In this embodiment of the present invention, the color-filtering SDA 104B is positioned above the SDA 104A of the character's face on the side of the upper 103. The upper 103 also includes other SDAs 104C on the sides of the footwear 101. The SDAs 104A, 104B, 104C can be in a consumer desirable shape, and be raised, recessed, and/or textured with respect to the non-SDA portions of the footwear 101.

FIG. 11B illustrates an embodiment of an innerliner 106 with a first portion 106A for positioning under the SDA 104A shaped as the face of the Teletubby, a second portion 106B for positioning under the color-filterings SDA 104B, and portions 106C, 106D for positioning under the other SDAs 104C on the sides of the footwear 101. The ankle portion 106E of the innerliner 106 is white, similar to an ankle portion of a typical sock. For children's television characters such as Teletubbies that are identified by their color, different innerliners 106 can be provided by varying the color of the various portions 106A, 106B, 106C, 106D of the innerliner 106 based on the colors of the particular Teletubby. Furthermore, the color-filtering SDA 104B modifies and displays the appearance of the colors visible through the SDA 104A when the innerliner is positioned under the color-filtering SDA 104B. In this example, the SDA 104B and the innerliner 106 interact to show the identifying mark (i.e., circle 108 in FIG. 11C) of the particular Teletubby.

FIG. 11C illustrates the combination of the footwear 101 shown in FIG. 11A and the innerliner 106 shown in FIG. 11B. The combination of the innerliner 106 and the footwear 101 results in a combined appearance that includes a particular Teletubby with its individual color, as shown in FIG. 11C. The color-filtering SDA 104B in this particular case displays a circle 108. Thus, in this embodiment, the Teletubby shown on the footwear 101 is identified by the colors shown through the SDA 104A and by the circle 108 that is shown through the color-filtering SDA 104B since the portion 106B of the innerliner 106 underlying the color-filtering SDA 104B includes transparent pigments that absorb the colors that would otherwise obscure the clarity of the circle design. The other SDA 104C also displays the same color of the Teletubby that is shown using the SDA 104A that is shaped as the face of the Teletubby or they can show other colors or appearances.

Thus, the SDA can be used as a filter to display hidden attributes of the innerliners, e.g., a color or design that can be used to identify a children's television character, and/or by altering the apparent color or appearance of the innerliner.

Another example of an optical effect provided by the SDA occurs when the SDA magnifies the attributes of the innerliners. Small attributes of an innerliner can be enlarged or emphasized by displaying the attributes on the innerliner through a SDA that is or contains properly shaped lenses.

Figures 12A, 12B, 12C:
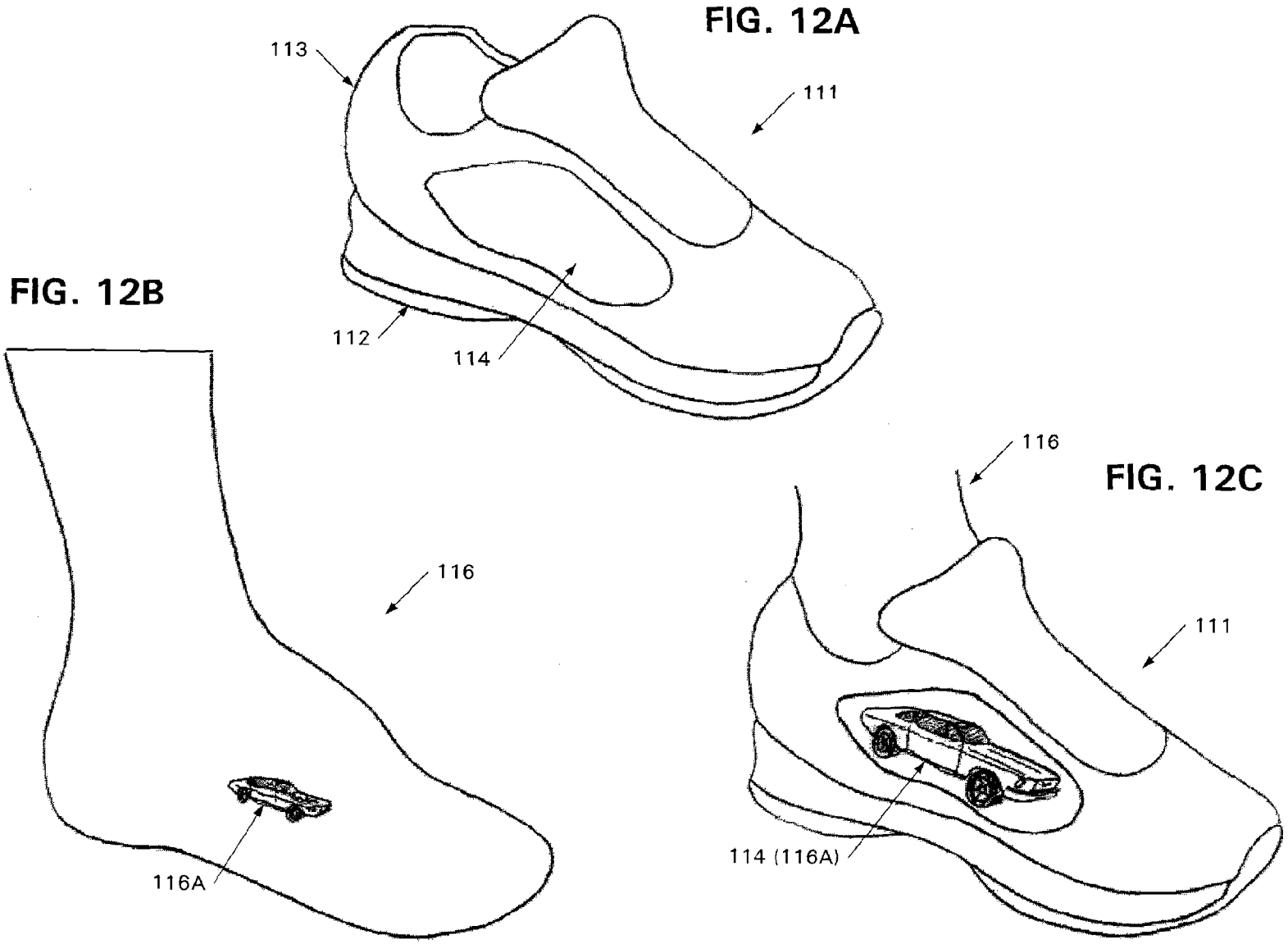
FIG. 12A is a perspective view of footwear according to an twelfth embodiment of the present invention that includes a SDA that magnifies attributes of the innerliner.
FIG. 12B is a perspective view of an innerliner designed for use with the footwear of FIG. 12A according to the twelfth embodiment of the present invention.
FIG. 12C is a perspective view of the combination of the footwear and innerliner of FIGS. 12A and 12B, respectively.

FIG. 12A illustrates a twelfth embodiment of footwear 111 of the present invention having a sole 112 and an upper 113. The footwear 111 includes a magnifying SDA 114 located on the side of the upper 113. The magnifying SDA 114 is or contains a properly shaped magnifying lens. FIG. 12B illustrates an embodiment of an innerliner 116 with a portion 116A positioned under the SDA 114 on the side of the footwear 111 that includes a small image of a car.

FIG. 12C illustrates the combination of the footwear 111 shown in FIG. 12A and the innerliner 116 shown in FIG. 12B. The combination of the innerliner 116 and the footwear 111 results in a combined appearance in which the portion 116A of the innerliner 116 positioned under the SDA 114 so that the small image of the car is magnified through the magnifying SDA 114 to produce an enlarged image of the car.

Another example of an optical effect that can be created through the interaction of the SDA and innerliner is to provide a three-dimensional appearance when the innerliner is displayed through the SDA. Methods for achieving the appearance of three dimensions may include: incorporating three dimensional objects on the innerliner or into the SDA; the use of position, color, shadowing, patterns, to provide the illusion of depth; incorporating materials into the SDA that reflect, refract, diffuse, suffuse, disperse or magnify light, such that when the innerliner is displayed through the SDA, the combination either appears to have or does have three dimensions.

The three-dimensional effect described above does not refer to the result of putting an innerliner behind a SDA, such that when the combination is observed, the difference in the depth of the innerliner in relation to the SDA provides the appearance of depth. Rather, the three-dimensional effect described results from the interaction of the innerliner and the SDA, e.g., a red innerliner used in combination with a SDA that has a heart formed of light-diffusing material located within an otherwise transparent SDA, would result in the appearance of a red background, with a red heart that appears to emanate from within the SDA. The three-dimensional effect described above can result from an attribute of the innerliner appearing as if it emanates from the SDA, from attributes of the innerliner emanating from differing depths within the SDA, from the SDA enhancing an innerliner that has or appears to have three dimensions or an innerliner enhancing an SDA that has or appears to have three dimensions.

The present invention also provides a vehicle for displaying the advertisements of multiple companies. Multiple innerliners with different advertisements can be interchanged with a single pair of footwear.

Figures 13A, 13B, 13C:
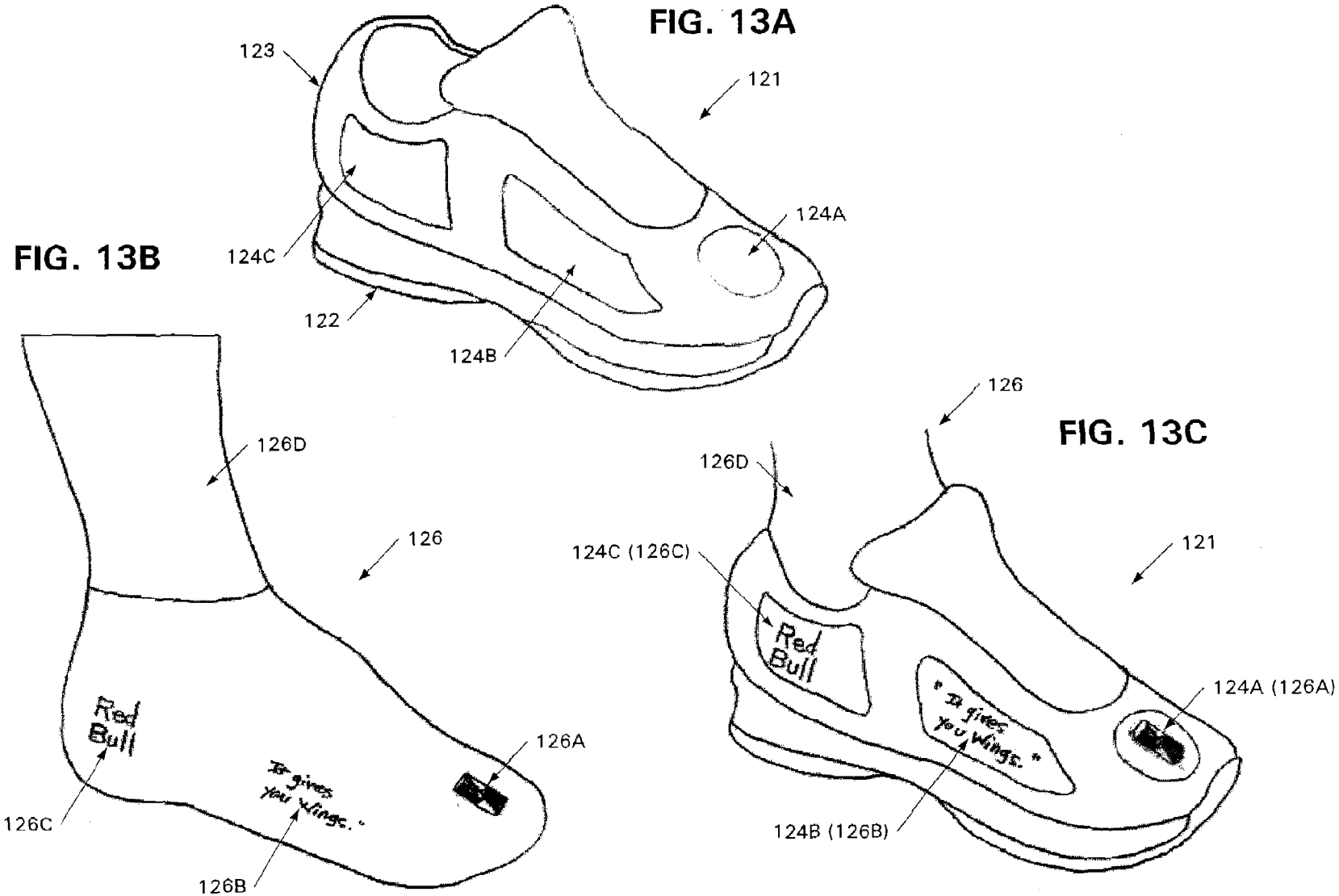
FIG. 13A is a perspective view of footwear according to a thirteenth embodiment of the present invention.
FIG. 13B is a perspective view of an innerliner with text and images, which is designed for use with the footwear of FIG. 13A according to the thirteenth embodiment of the present invention.
FIG. 13C is a perspective view of the combination of the footwear and innerliner of FIGS. 13A and 13B, respectively.

FIG. 13A illustrates a thirteenth embodiment of footwear 121 of the present invention having a sole 122 and an upper 123. The footwear 121 includes SDAs 124A, 124B, 124C located on the sides and top of the upper 123. FIG. 13B illustrates an innerliner 126 with a two-dimensional design showing a beverage can 126A and other various information such as a slogan 126B ("It gives you wings") and a name of the product 126C (Red Bull). The ankle portion 126D of the innerliner 126 is white, similar to an ankle portion of a typical sock.

The SDA 124A located at the front of the footwear 121 is made of a material or materials that give the two-dimensional design on the innerliner 126 underlying the SDA 124A, e.g., the beverage can 126A, the appearance of being three dimensional. To create this three-dimensional appearance, the SDA 124A uses a combination of line positioning, coloring, and shadowing of the image of the beverage can 126A on the innerliner 126 and also includes light suffusing materials at differing depths within the SDA 124A.

FIG. 13C illustrates the combination of the footwear 121 shown in FIG. 13A and the innerliner 126 shown in FIG. 13B. The combination of the innerliner 126 and the footwear 121 results in a combined appearance in which the two-dimensional design of the beverage can 126A on the innerliner 126 is displayed as a three-dimensional image using the SDA 124A located at the top of the upper 123, as shown in FIG. 13C.

The various pieces of information 126B, 126C printed on the side of the innerliner 126 are displayed through the other SDAs 124B, 124C. Thus, the footwear and SDAs may utilize a "generic" design that is adapted to endorse a large array of products by producing different innerliners. The SDAs can display the product name, a slogan, and/or other product information.

Another example of an optical effect occurs when the SDA allows varying degrees of light to be transmitted, e.g., from transparent to translucent, across its area. The SDA can cover a solid-colored portion of the innerliner to create a fading appearance when viewing the SDA from outside of the footwear.

Figures 14A, 14B, 14C:
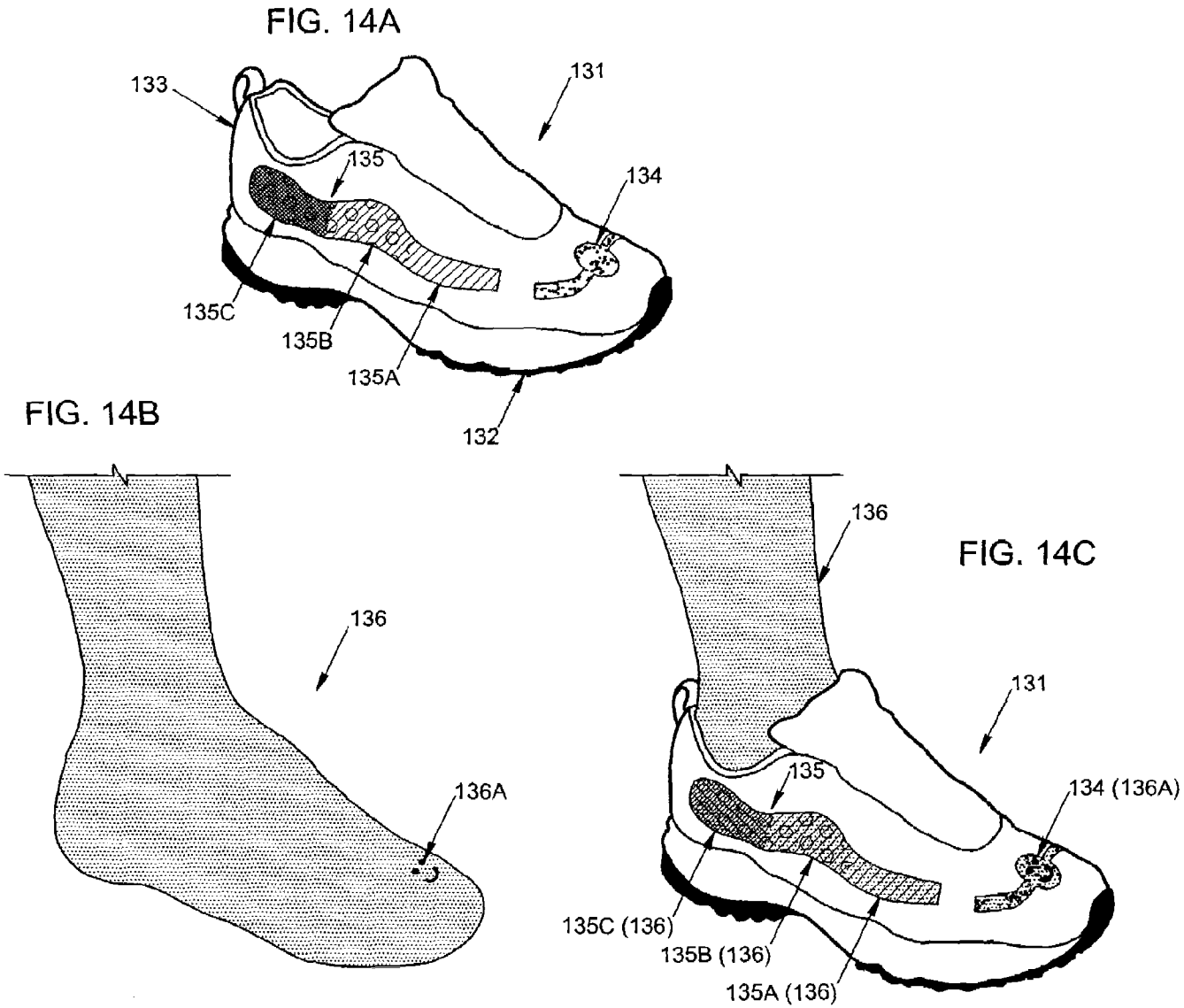
FIG. 14A is a perspective view of footwear according to a fourteenth embodiment of the present invention with a SDA that makes the appearance of an innerliner sparkly and a SDA that transmits varying degrees of light.
FIG. 14B is a perspective view of an innerliner designed for use with the footwear of FIG. 14A according to the fourteenth embodiment of the present invention.
FIG. 14C is a perspective view of the combination of the footwear and innerliner of FIGS. 14A and 14B, respectively.

FIG. 14A illustrates a fourteenth embodiment of footwear 131 of the present invention having a sole 132 and an upper 133. The footwear 131 includes SDAs 134 and 135, located on the top and sides of the upper 133. SDA 134 is located at the top of the toe of the footwear 131 contains non-transparent sparkles. SDA 135 is located on the side of the footwear 131 and has three sections 135A, 135B, and 135C which transmit different amounts of light. SDA section 135A is transparent. SDA section 135C is translucent and transmits less light than SDA section 135A and SDA section 135B. SDA 135B transmits an intermediate degree of light, which is less than the amount transmitted by transparent SDA section 135A and more than the amount transmitted by translucent SDA section 135C. The SDA sections 135A, 135B, and 135C are positioned adjacent to each other to form a single continuous SDA with one end (SDA section 135A) that is transparent and the opposite end (SDA section 135C) that is translucent. Thus, the SDA sections 135A, 135B, and 135C are formed such that SDA 135 ranges from transparent to translucent and transmits varying degrees of light. FIG. 14B illustrates an innerliner 136 of a single solid color with a design 136A, e.g., a smiley face, on top of the toe of the innerliner 136.

FIG. 14C illustrates the combination of the footwear 131 shown in FIG. 14A and the innerliner 136 shown in FIG. 14B. The combination of the innerliner 136 and the footwear 131 results in a combined appearance, which includes a SDA 135 on the side of the footwear 131, which varies in appearance across its body even though the innerliner 136 positioned underneath the SDA 135 is one solid color. This is due to the varying light transmitting characteristics of SDA sections 135A, 135B, and 135C.

This embodiment also illustrates the ability of the innerliner and SDA to interact through non-optical techniques. FIG. 14B illustrates an innerliner 136 of a single solid color with a design 136A, e.g., a smiley face, on top of the toe of the innerliner 136. The smiley face 136A on the innerliner 136 appears "sparkly" due to the non-transparent sparkles in SDA 134. Thus, the SDA of the present invention can interact with the appearance of an innerliner without requiring the modification of light that reaches the innerliner by providing a SDA that is formed in a particular shape and that includes non-transparent indicia or other features, such as sparkles. Thus, the sparkly SDA 134 shown in FIGS. 14A and 14C is one of several ways that a SDA can interact with the appearance of an innerliner in a non-optical technique. The modification of light may change the amount of light that is transmitted through the SDA, but the SDA is not effecting the design, color, or other characteristics of the innerliner.

Additional visual effects are created through the interaction of the innerliner and the SDA by using various materials whose appearance varies based upon various environmental and mechanical interactions. Examples of these materials and interactions include innerliners and/or SDA that include: glow-in-the-dark materials, such as the aluminate phosphors sold by Artemis US; photochromic materials, which change color due to variations in their exposure to ultraviolet (UV) light, such as Plastisol Light Sensitive Ink; thermochromic materials which change color in response to temperature fluctuations, such as thermochromic materials made by Detco Enterprise and Matsui; hydrochromic materials, which change in response to water; materials that use electricity, such as electrochromic materials that change color due to the external stimuli of electrical energy, e.g., neon; a motorized photo sensitive Polaroid filter; and LED lights which illuminate the innerliner and the SDA itself. Magnets or static electricity focusing materials can be used to create designs on the innerliners that are replicated when the innerliner is placed next to a fluid-filled SDA that contains free-floating colored particles which contain ferromagnetic materials.

Figure 15A:
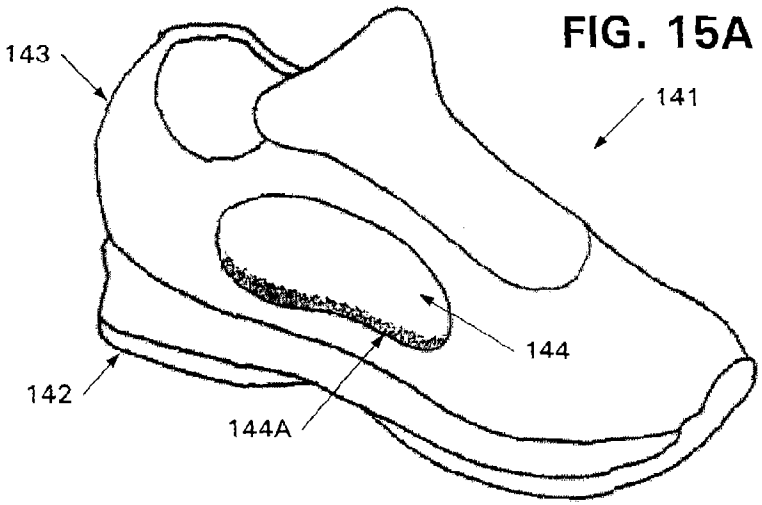
FIG. 15A is a perspective view of footwear according to a fifteenth embodiment of the present invention that includes a fluid filled SDA with particles that can be positioned using magnetized materials.

FIG. 15A illustrates a fifteenth embodiment of footwear 141 of the present invention having a sole 142 and an upper 143. The footwear 141 includes a fluid-filled SDA 144 located on the side of the upper 143. The fluid-filled SDA 144 also contains non-transparent particles 144A that include ferromagnetic materials which move freely in the fluid inside the SDA 144. In this embodiment of the invention, the ferromagnetic materials 144A are colored white.

Figure 15B:
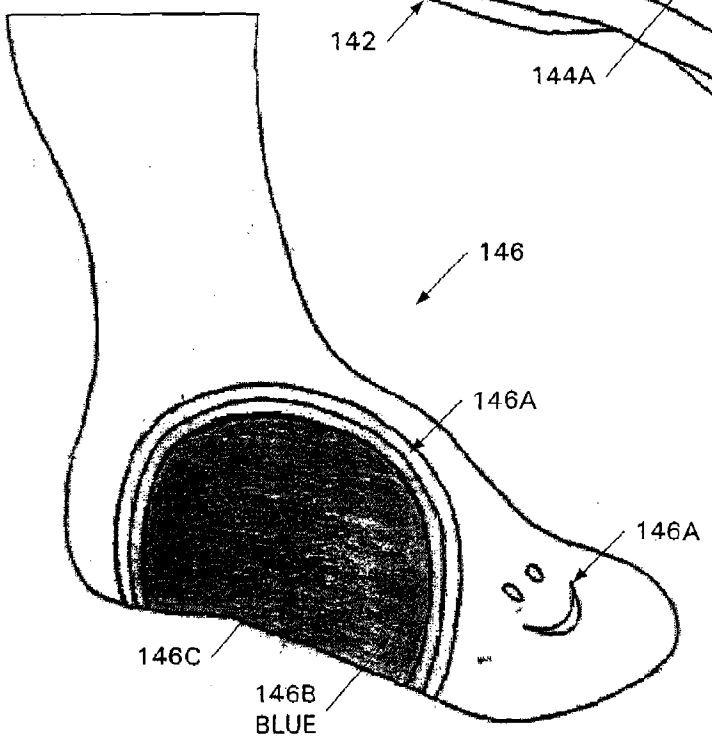
FIG. 15B is a perspective view of an innerliner incorporating magnetized materials designed for use with the footwear of FIG. 15A according to the fifteenth embodiment of the present invention.

FIG. 15B illustrates an innerliner 146 with designs 146A, e.g., a smiley face on top of the toe and a rainbow on the side of the innerliner 146. The designs 146A are not intended to be visible through the footwear 141. The innerliner 146 also includes an area 146B colored blue, that has magnetic materials 146C woven into the innerliner 146. The magnetic materials 146C are shown in FIG. 15B as visible to the user. However, the magnetic materials 146C can also be incorporated into the innerliner 146 so that they are not visible. In this embodiment of the invention, the magnetic materials 146C are formed in the shape of a smiley face.

Figure 15C:
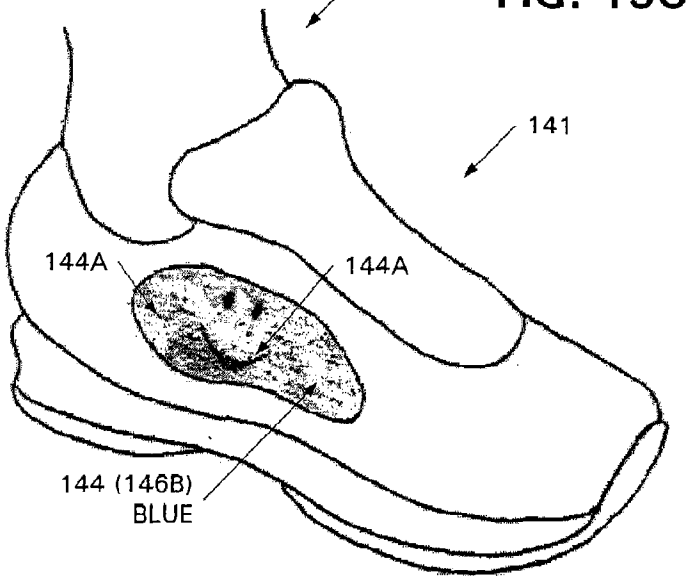
FIG. 15C is a perspective view of the combination of the footwear and innerliner of FIGS. 15A and 15B, respectively.

FIG. 15C illustrates the combination of the footwear 141 shown in FIG. 15A and the innerliner 146 shown in FIG. 15B, which results in an appearance in which the particles containing ferromagnetic materials 144A in the SDA 144 are attracted to the magnetic materials 146C in the blue-colored portion 146B of the innerliner 146 positioned underneath the SDA 144. Thus, some of the white particles containing ferromagnetic materials 144A are held in place by the magnetic field caused by the magnetic materials 146C formed in the shape of a smiley face in the blue-colored portion 146B of the innerliner 146 so that a white-colored smiley face appears above a blue background in the SDA 144 on the footwear 141. The particles containing ferromagnetic materials 144A that are not held in place by the magnetic field 146C float freely in the SDA 144.

It is thus possible for the SDA and/or innerliner to change appearance based upon environmental and/or mechanical influences. This change in appearance of the SDA and/or innerliner would thus alter the combined appearance that incorporates the result of their interaction with the appearance of the remainder of the footwear. Furthermore, by leveraging the fact that the SDA and/or innerliner can change appearance based on various environmental and mechanical interactions, one can create a multitude of additional combined appearances, and the users influence the combined appearance of their footwear, e.g., by running to facilitate the movement of particles in a fluid-filled SDA or to heat up thermochromic materials.

Structure

This invention includes multiple structural improvements to footwear with an SDA and innerliners, which may be important to the success of the above described footwear system as well as various other applications. Within the footwear system the structural improvements allow for enhanced user comfort, improved performance, precise consumer reproducible combined appearances, and the ability to repeatedly and effectively reproduce the combined appearance over the product's life.

The SDA and the innerliners are made from materials designed in various configurations to maximize comfort, durability, dispersion of heat and moisture, especially in the areas of the innerliners that are displayed through the SDA, as well as to help maintain the spatial relationship between the footwear, SDA, and innerliners during normal usage and during their life cycle. The normal usage and life cycle includes the stages of breaking in, stretching, washing, and wearing the footwear system, as well as the effects of heat and moisture. Normal usage and life cycle of the footwear can also include, in some embodiments, the usage of the innerliners without using the footwear. For instance, the innerliners can be made of more durable colorfast materials if the innerliner is subject to repeated washing and non-footwear use.

The structure, the expansion and contraction properties, and the material degradation characteristics of the innerliners, the footwear, and the SDA are designed to maintain the footwear's ability to display and enhance the user desirable portions of the innerliners through normal usage and the life cycle of the footwear.

User comfort can be maintained during the normal usage of the footwear with the SDA and associated innerliner by coordinating one or more of the following characteristics of the innerliners, footwear, and SDA including: their size, shape, dimensions, materials, consistency, flexibility, support properties and characteristics. For example, the materials and design of the innerliners, footwear, and the SDA can be altered to allow the innerliners, footwear, and/or the SDA to maintain suitable temperature and humidity levels throughout the normal usage. Additionally, the incorporation of soft materials such as rubber, neoprene or silicon into the footwear system provides cushioned support therethrough. Suitable temperature and humidity levels can be provided by incorporating and coordinating one or more heat and moisture dispersion characteristics of the innerliners, footwear, and the SDA.

Figure 16B:
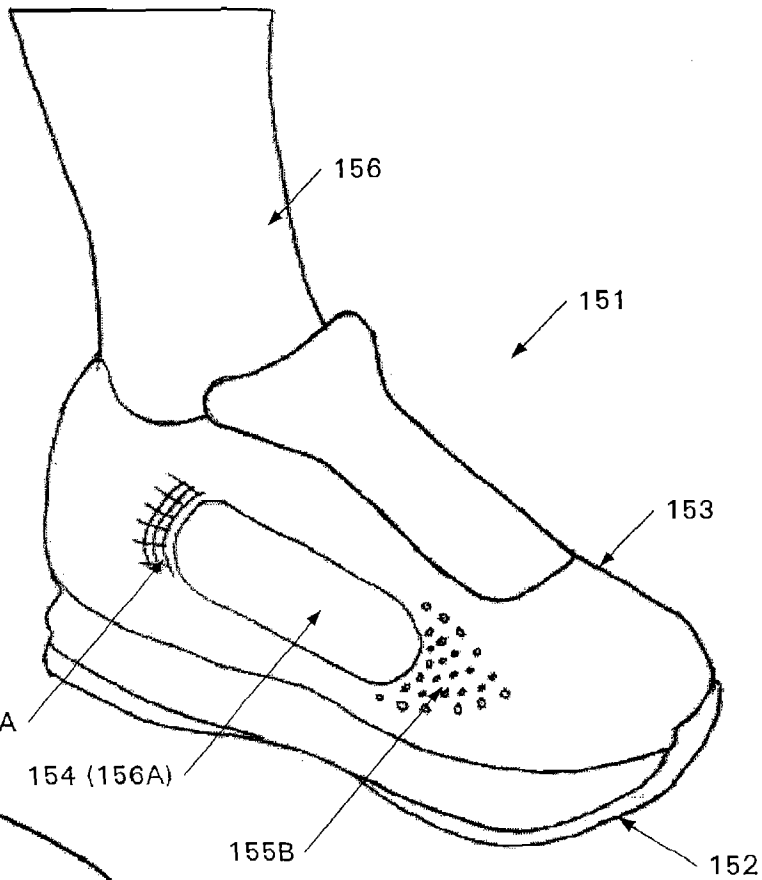
FIG. 16B is a perspective view of the combination of footwear according to the sixteenth embodiment of the present invention and the innerliner of FIG. 16A.
Figure 16A:
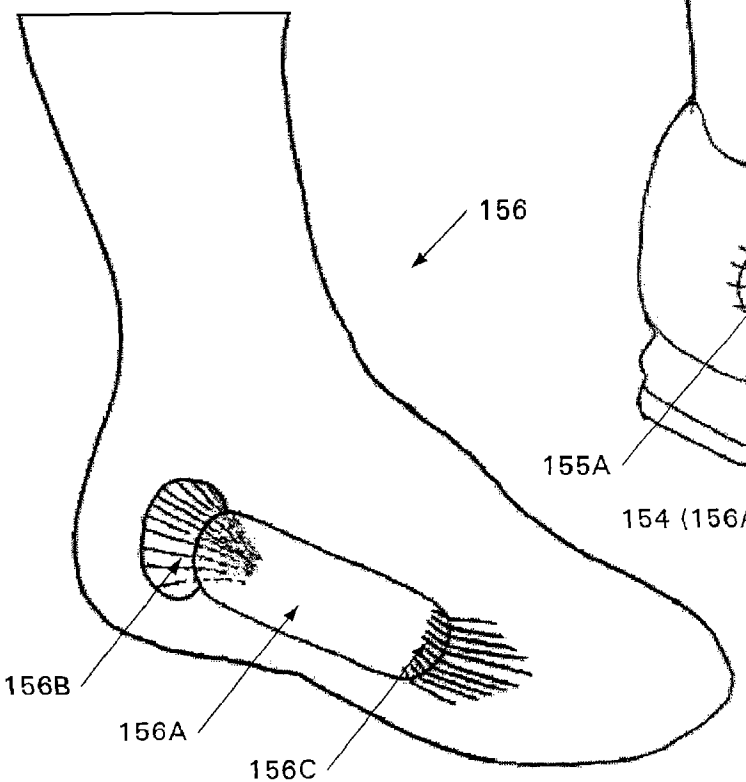
FIG. 16A is a perspective view of an innerliner according to a sixteenth embodiment of the present invention with temperature and humidity control areas.

FIG. 16A illustrates a sixteenth embodiment of an innerliner 156 of the present invention that is designed to maintain suitable temperature and humidity levels. The innerliner 156 is preferably used with footwear that is also designed to maintain suitable temperature and humidity levels, e.g., an embodiment of footwear 151 shown in FIG. 16B. An area 156A of the innerliner 156 is displayed through a SDA 154. The innerliner 156 includes at least a portion 156B formed of a wicking material to help draw moisture away from the foot. Examples of materials that wick moisture are DuPont's CoolMax® polyester, SmartWool™, Merino wool, and WonderWick® polypropylene. The innerliner 156 also includes at least a portion 136C formed of air channels to help transfer heat away from the foot.

FIG. 16B illustrates the combination of the innerliner of FIG. 16A and the footwear 151 of the present invention that is designed to maintain suitable temperature and humidity levels within the footwear 151. The footwear 151 includes a sole 152, an upper 153, and the SDA 154 located on the side of the upper 153.

At least a portion 155A of the footwear 151, e.g., near at least a portion of the SDA 154, can be made of one of the wicking materials to wick moisture away from the innerliner 156. The moisture is drawn away the innerliner 156 so that it may evaporate outside of the footwear 151. In addition, at least a portion of the footwear 151, e.g., near at least a portion of the SDA 154, includes holes or breathable materials 155B located near at least a portion of the SDA 154. The holes or breathable materials 155B allow the removal of excess heat that may build up between the innerliner 156 and the footwear 151.

Thus, the footwear and the innerliners can be designed to help control the temperature and humidity levels within the footwear, e.g. by using moisture wicking materials and/or incorporating holes or other breathable materials within the footwear and/or the innerliners.

Many of the design options made possible by this invention require substantial precision in aligning and interrelating the innerliner and the SDA, in order to achieve precise combined appearances that can be readily and easily recreated by the user and maintained during normal usage. Multiple advances are detailed below that allow for increased precision in controlling and maintaining the spatial relationship between the innerliner, footwear, SDA and user's foot.

One way of improving the footwear's ability to display and enhance the user desirable portions of the innerliners is by controlling the spatial relationship of the innerliner, foot, and footwear. Strength bands are incorporated into the footwear and/or the innerliners to help control the spatial relationship of the innerliner, foot, and footwear. The strength bands can be incorporated into the innerliner and/or the footwear that go around conducive areas of the foot such as at the arch or ankle connection, or in conjunction with the lacing system in order to limit the movement between the innerliner and foot and/or between the footwear and the foot, in order to provide additional control over the spatial relationship between the innerliners, the SDA, and the footwear.

Figure 17:
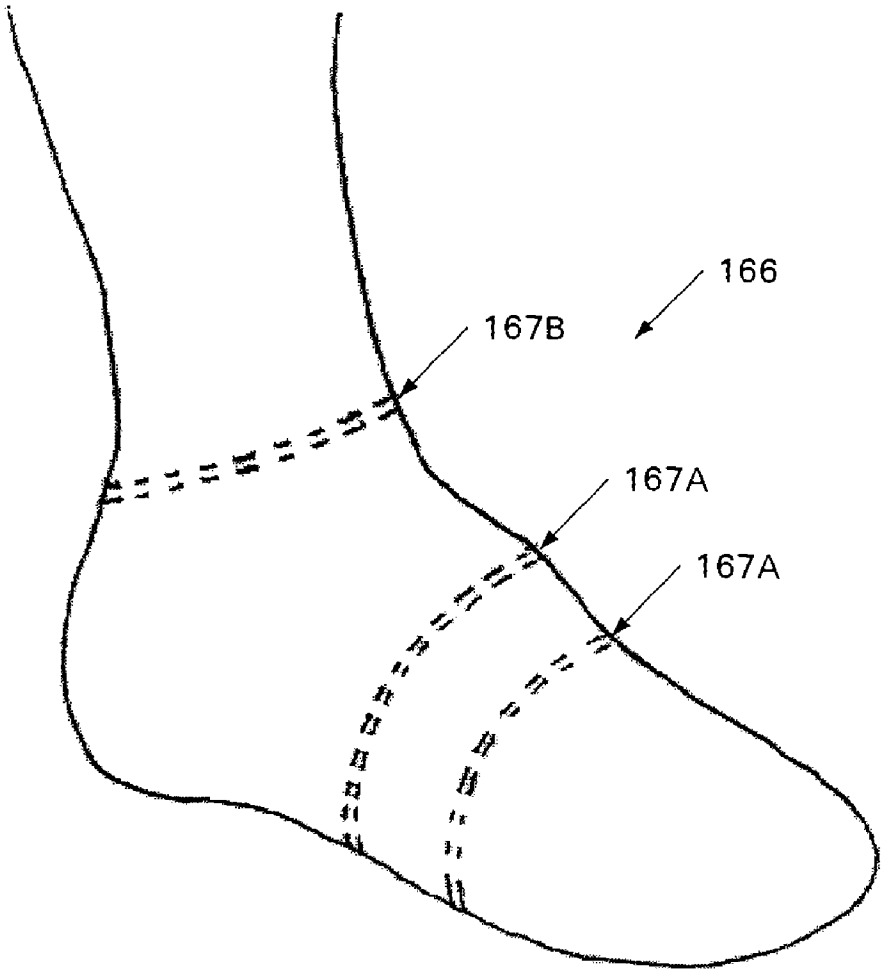
FIG. 17 is a perspective view of an innerliner having strength bands according to a seventeenth embodiment of the present invention.

FIG. 17 illustrates a seventeenth embodiment of an innerliner 166 with strength bands 167A around the arch of the foot and strength bands 167B around the ankle. The strength bands 167A, 167B can be formed using Lycra®, Luzima®, Spandex®or Cordura® nylon reinforcements.

Another way of maintaining the spatial relationship of the innerliner, foot and footwear is by engineering innerliners and/or footwear that maintain their orientation with respect to the feet and to each other during normal usage of the footwear system. The innerliners are thus engineered to maintain their orientation with respect to the feet by coordinating one or more of the following characteristics: the size and shape of the innerliners, the expansion and contraction properties of the innerliners, the materials of the innerliners, the effects of heat and moisture, other characteristics of the innerliners, and foot dimensions. The footwear is engineered to maintain its orientation with respect to the feet during normal usage of the footwear by coordinating one or more of the following characteristics: the size and shape of the footwear, the expansion and contraction properties of the footwear, the materials of the footwear, the effects of heat and moisture, other characteristics of the innerliners, and foot dimensions.

The spatial relationship between the innerliner and footwear, and more specifically, the distance between the innerliner and the SDA or the pressure applied by the innerliner on the SDA can be controlled by coordinating one or more of the following characteristics: the size, shape, and layout of the innerliner, footwear, and SDA; the expansion and contraction characteristics of the innerliner, footwear, and SDA; the materials of the innerliner, footwear, and SDA; the effects of heat and moisture; other characteristics of the innerliner, footwear, and SDA; and foot dimensions.

Additional control of the spatial relationship between the innerliners, the footwear, and SDA can be attained and maintained by the design and coordination of one or more of the following: the materials and attributes on the exterior of the innerliners and on the interior of the SDA and remaining footwear. Examples of materials in the innerliners, the SDA, and the footwear that can enable additional control of the spatial relationship between the innerliners and the SDA include Velcro®, rubber, magnets, silicone and Teflon®. Attributes of the innerliners, the SDA, and the footwear that can enable additional control of the spatial relationship between the innerliners, the footwear, and the SDA include materials that adhere to each other; form fitting materials that fit snugly around the foot or within the footwear; rough surfaces that limit movement due to friction; smooth areas that facilitate movement in certain areas; an airtight concave area that limits movement through use of a vacuum effect; and areas which are electrically charged (e.g., with static electricity) and that limit movement by leveraging opposite attractive electrical forces.

Furthermore, topography can be use on innerliners and the interior of the SDA and the non-SDA portions of the footwear in order to manage the alignment of the innerliner, footwear and SDA. For example the system can be can be designed and coordinated so that the inner topography of the footwear can be engineered to "fit together", or interlock with the outer topography of the innerliners. Thus, portions of the innerliners' outer topography can be inversely engineered with respect to the inner topography of the footwear and the SDA. The innerliners can be held in place within the footwear because their topography fits together developing interrelational strength, which allows for additional control of the spatial relationship between the innerliners, the SDA, and the footwear.

Figures 18A, 18B, 18C, 19A, 19B, 19C:
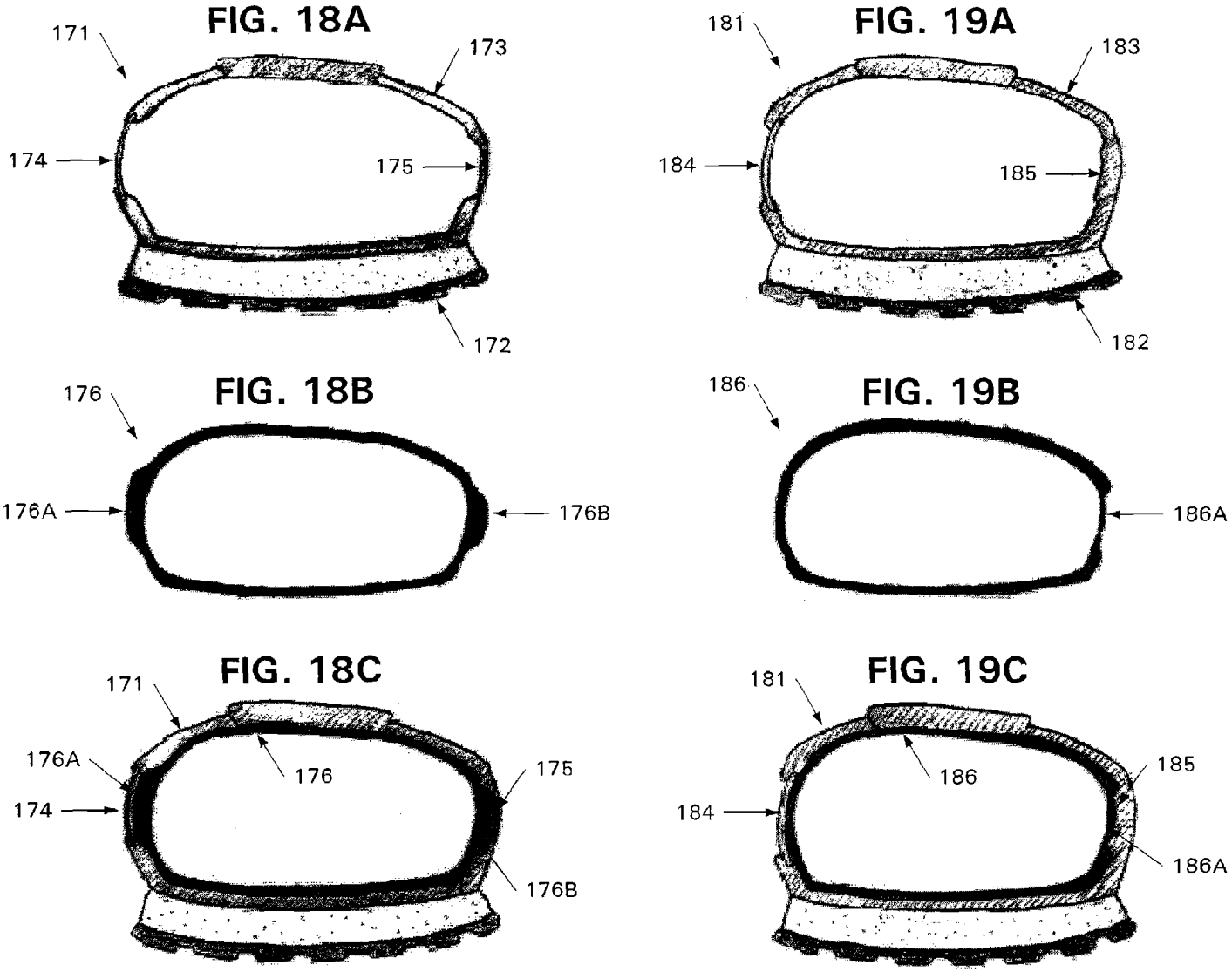
FIG. 18A is a cross section of footwear according to an eighteenth embodiment of the present invention with recessed portions that interlock with a corresponding innerliner.
FIG. 18B is a cross section of an innerliner, which is designed for use with the footwear of FIG. 18A according to the eighteenth embodiment of the present invention.
FIG. 18C is a cross section of the combination of the footwear and innerliner of FIGS. 18A and 18B, respectively.
FIG. 19A is a cross section of footwear according to a nineteenth embodiment of the present invention with a protrusion that interlocks with a corresponding innerliner.
FIG. 19B is a cross section of an innerliner, which is designed for use with the footwear of FIG. 19A according to the nineteenth embodiment of the present invention.
FIG. 19C is a cross section of the combination of the footwear and innerliner of FIGS. 19A and 19B, respectively.

FIGS. 18A-18C illustrate an example of an innerliner and footwear which are designed and engineered so that the outer topography of the innerliner is inversely engineered with respect to the inner topography of the footwear and the SDA.

FIG. 18A illustrates a cross section of an embodiment of footwear 171 of the present invention having a sole 172 and an upper 173. The footwear 171 includes a SDA 174 located on a side of the upper 173 and a positioning groove 175 located on the side of the footwear 171 opposite to the SDA 174. The SDA 174 and the positioning groove 175 are positioned so that they provide respective indentations in the interior surfaces of the sides of the upper 173 of the footwear 171.

FIG. 18B illustrates a cross section of an embodiment of an innerliner 176 with first and second protruding portions 176A, 176B positioned on the innerliner 176 that protrude outward from the exterior surface of the innerliner 176. The protruding portions 176A, 176B are received, respectively, by the indentations formed by the SDA 174 and the positioning groove 175 on the opposite sides of the footwear 171 when the innerliner 176 is placed inside the footwear 171.

FIG. 18C illustrates a cross section of the combination of the footwear 171 shown in FIG. 18A and the innerliner 176 shown in FIG. 18B. When the innerliner 176 is properly placed inside the footwear 171, the indentation formed by the SDA 174 receives the first protruding portion 176A on the innerliner 176, and the indentation formed by the positioning groove 175 on the opposite side of the footwear 171 receives the second protruding portion 176B on the innerliner 176. Thus, the innerliner 176 interlocks with the footwear 171. FIG. 18C also shows that the innerliner 176, footwear 171 and SDA 174 can be designed to leave a space between the SDA 174 and the innerliner 176A. Alternatively, the SDA 174 and the first protruding portion 174 may be sized in order to prevent the existence of a space between the innerliner and SDA.

FIGS. 19A-19C illustrate another way in which the interior topography of the footwear can be formed to interlock with the exterior topography of the innerliner. FIG. 19A illustrates a cross section of an embodiment of footwear 181 of the present invention having a sole 182 and an upper 183. The footwear 181 includes a SDA 184 located on a side of the upper 183 and a positioning protrusion 185 located on the side of the footwear 181 opposite to the SDA 184. The interior surface of the SDA 184 is positioned flush with the interior surface of the non-SDA portions of the upper 183 of the footwear 181. The protruding portion 185 in the footwear 181 is positioned so that it protrudes into the interior of the upper 183 of the footwear 181. Thus, the footwear 181 shown in FIG. 19A has a different interior topography than the footwear 171 shown in FIG. 18A.

Also, the innerliner 186 shown in FIG. 19B has a different exterior topography than the innerliner 176 shown in FIG. 18B. FIG. 19B illustrates a cross section of an embodiment of an innerliner 186 with a positioning groove 186A formed as an indentation on the exterior surface of the innerliner 186. The positioning groove 186A is positioned under the protruding portion 185 on the side of the footwear 181 opposite the SDA 184 when the innerliner 186 is placed inside the footwear 181.

FIG. 19C illustrates a cross section of the combination of the footwear 181 shown in FIG. 19A and the innerliner 186 shown in FIG. 19B. When the innerliner 186 is properly placed inside the footwear 181, the indentation formed in the innerliner 186 receives the protruding portion 185 on the interior surface of the footwear 181. Thus, the innerliner 186 can form interrelational strength with footwear 181 because its topography fits together with the footwear 181. Due to this interrelation strength, a specific portion of the innerliner 186 displays through the SDA 184. Furthermore, since the interior surface of the SDA 184 is positioned flush with the interior surface of the non-SDA portions of the footwear 181, the SDA 184 is positioned flush against the exterior surface of the innerliner 186, thus limiting any space in between the innerliner and the SDA.

While this example illustrates interlocking topography, it should be understood that topography can be used of any individuals or group of elements, in any configuration or structure, in order to manage the spatial relationship between the innerliner, foot, and footwear, and aligning the innerliner sections intended for the display with SDA. The spatial relationship of the innerliners and the SDA can be maintained over the life cycles of the footwear and innerliners by also coordinating one or more of the aging and wear characteristics of the materials and structures of the innerliners, footwear, and the SDA.

Another way of managing the spatial relationship between the innerliner, foot, and footwear, and aligning the innerliner sections intended for the display with SDA, is to engineer the display section of the innerliner to have some freedom of movement with respect to the rest of the innerliner. For example by attaching a display section to an innerliner with an elastic material, the display section would have an increased degree of movement. Thus, it could maintain its alignment with the SDA even if the innerliner moved within the footwear and thus could compensate for normal sizing variances, stretching and movement during usage of the footwear system. This embodiment of the present invention, combined with topography described above allows for the very precise management of the spatial relationship between the innerliner and SDA The spatial relationship between the SDA and the innerliner can also affect the result of the combination of the innerliner and the SDA. For example, the appearance of the combined innerliner and the SDA may vary based on whether the exterior surface of the innerliner is in contact with the interior surface of the SDA or if there is a space between them. The appearance of the combined innerliner and the SDA may also vary based on the amount of pressure with which the exterior surface of the innerliner contacts the interior surface of the SDA. Moreover, the appearance of the combined innerliner and the SDA may vary where only portions of the exterior surface of the innerliner contacts the interior surface of the SDA. Lastly, the appearance of the combined innerliner and the SDA may vary where the relationship between the exterior surface of the innerliner and the interior surface of the SDA changes during usage. The change in the relationship between the exterior surface of the innerliner and the interior surface of the SDA is in the form of the distance between them, the pressure with which they contact, the alignment between them, or any combination of the aforementioned.

Examples of ways to create this optical and visual effects might include: changing the innerliner's distance from a SDA that has magnifying properties; utilizing piezochromic materials, which change color in response to pressure; including a foil-like material on the innerliner that changes shape and appearance when it contacts the denser surface of the SDA; and using an innerliner having varied topography across the area underlying the SDA, thereby creating ridges and valleys which present a varied appearance when relatively motionless. This appearance changes based upon lateral movement of the innerliner in relation to the SDA.

Figure 20B:
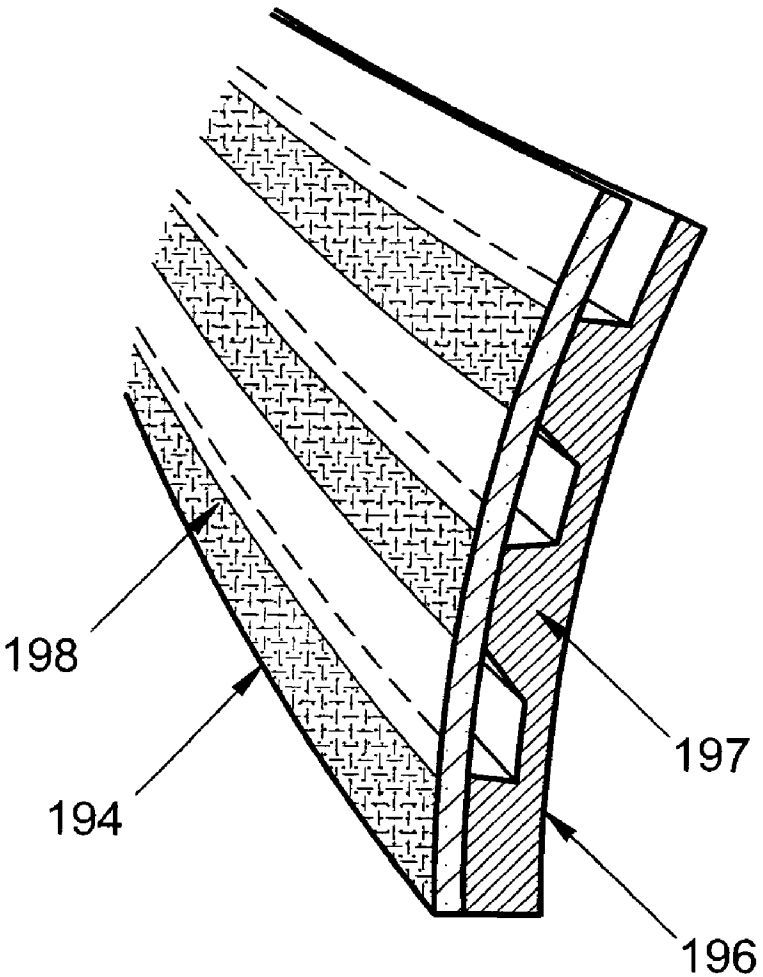
FIG. 20B is an enlarged cross section of the combination of the footwear and the innerliner of FIG. 20A without the gap.
Figure 20A:
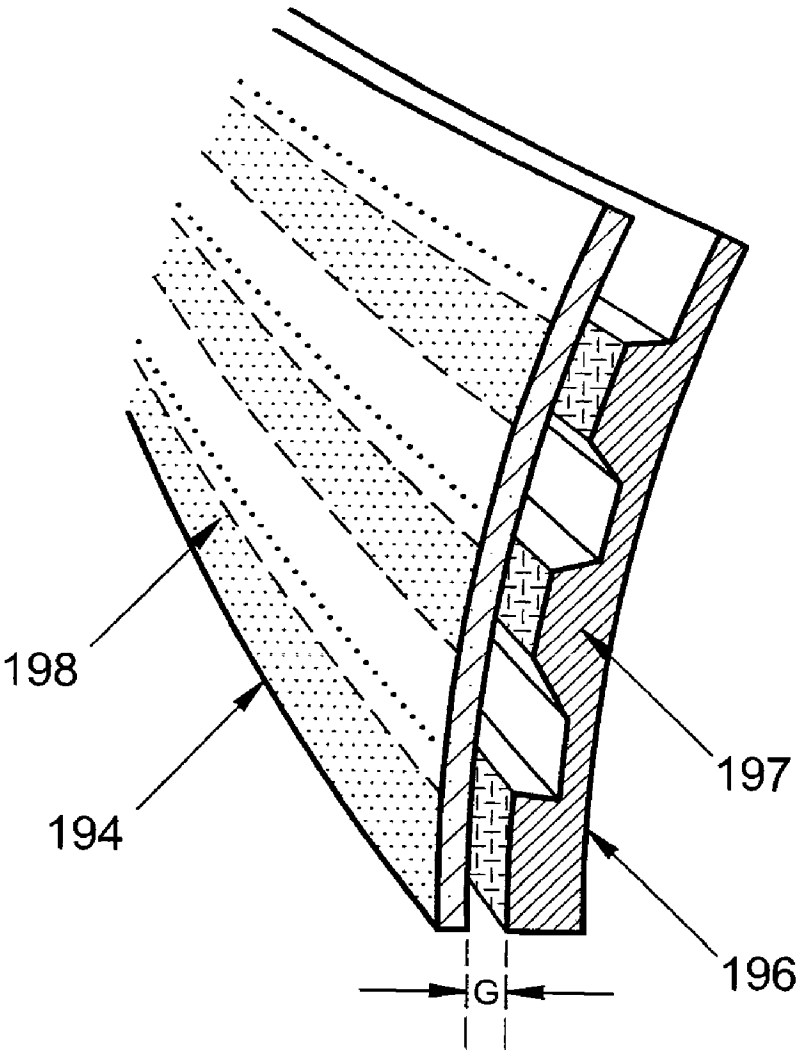
FIG. 20A is an enlarged cross section of a combination of footwear and an innerliner with a small gap in-between them.

FIGS. 20A and 20B illustrate an embodiment of the present invention in which an innerliner has a varied topography across the area underlying the SDA. This type of innerliner creates different appearances for the footwear depending on the position of the innerliner. For instance, different appearances are created when the innerliner is relatively motionless at different positions with respect to the SDA and when the innerliner is moving laterally in relation to the SDA. FIG. 20A illustrates a cross section of a SDA 194 and an innerliner 196 when there is a gap G between the SDA 194 and the innerliner 196. Ridges 197 on the innerliner 196 provide a design 198 that is visible through the SDA 194. When there is a gap G between the exterior surface of the ridges 197 on the innerliner 196 and the interior surface of the SDA 194, the design 198 formed by the ridges 197 on the innerliner 196 appears muted and less bright.

The innerliner 196 is free to move laterally with respect to the SDA 194, i.e., towards and away from the SDA 194, and as the gap G becomes smaller as the innerliner 196 moves toward the SDA 194, the relative definition of the design 198 formed by the ridges 197 on the innerliner 196 increases. FIG. 20B illustrates a cross section of the SDA 194 and the innerliner 196 after the innerliner 196 has moved laterally with respect to the SDA 194 so that the upper surface of the ridges 197 on the innerliner 196 is positioned flush against the interior surface of the SDA 194. Therefore, there is no gap between the exterior surface of the ridges 197 on the innerliner 196 and the interior surface of the SDA 194. In this configuration, the design 198 formed by the ridges 197 on the innerliner 196 appears clearer.

This embodiment of the invention produces footwear having a changing appearance when the innerliner moves with respect to the SDA. As shown in FIGS. 20A and 20B, due to the design and engineering of the footwear, SDA, and innerliner, the portion of the innerliner under the SDA includes a degree of freedom to move laterally relative to the SDA in response to movement of the user's foot. The portion of the innerliner under the SDA moves laterally relative to the SDA to leave, at times, varying amounts of space between the innerliner and the SDA. The movement of the innerliner under the SDA results in a variation in the intensity of the appearance of the attributes or design on the innerliner, as viewed from the exterior of the footwear.

Innerliners

Figure 21:
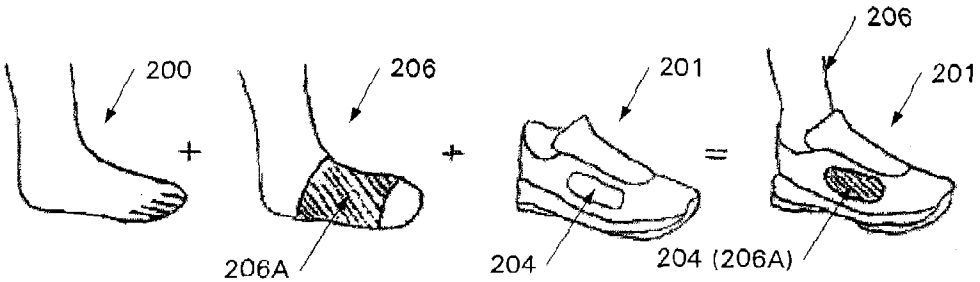
FIG. 21 is a diagram showing the steps for putting an innerliner on a user's foot and placing the innerliner covered foot into the footwear, according to an embodiment of the present invention.

There are several different embodiments of an innerliner. For example, FIG. 21 illustrates the most common conception of an innerliner and how it would be incorporated with footwear with the SDA. FIG. 21 illustrates footwear 201 having a SDA 204, an innerliner 206 having a displayable portion 206A, and the user's foot 200, according to an embodiment of the present invention. The innerliner 206 is placed directly on the user's foot 200, and then the user's foot 200 is inserted into the footwear 201 and removed from the footwear 201 together with the innerliner 206.

Figure 22A:
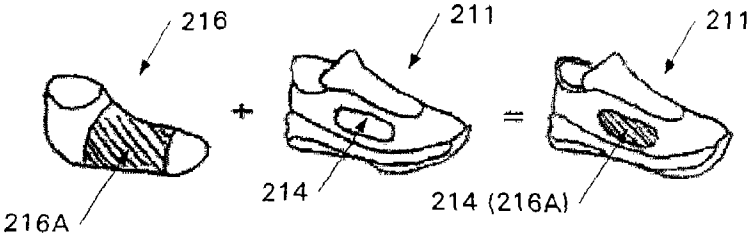
FIG. 22A is a diagram showing the steps for inserting an innerliner into footwear, according to an embodiment of the present invention.
Figure 22B:
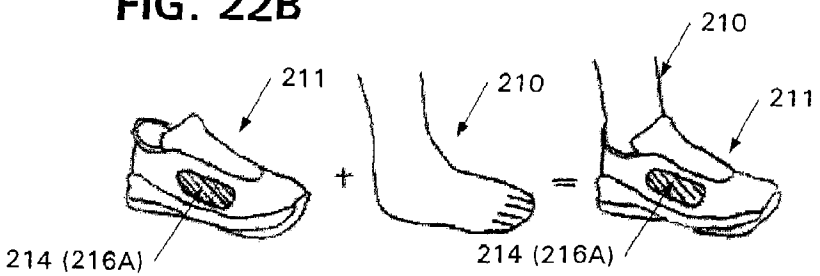
FIG. 22B is a diagram showing the steps for placing a user's foot into the combined footwear and the innerliner of FIG. 22A.

FIGS. 22A and 22B illustrate another way in which an innerliner can be incorporated with the footwear. FIGS. 22A and 22B illustrate footwear 211 having a SDA 214, an innerliner 216 having a displayable portion 216A, and the user's foot 210. As shown in FIG. 22A, the innerliner 216 is first inserted directly into the footwear 211. Then, as shown in FIG. 22B, after the innerliner 216 is inserted into the footwear 211, the innerliner 216 and the footwear 211 are placed on the user's foot 210. The innerliner 216 and the footwear 211 are placed onto and removed from the user's foot 210 as a single unit.

With the embodiment of the present invention shown in FIGS. 22A and 22B, the user uses the combination of the footwear 211 and the innerliner 216 with bare feet and therefore does not have to insert a new innerliner into the footwear 211 each time the user uses the footwear 211.

Figure 23:
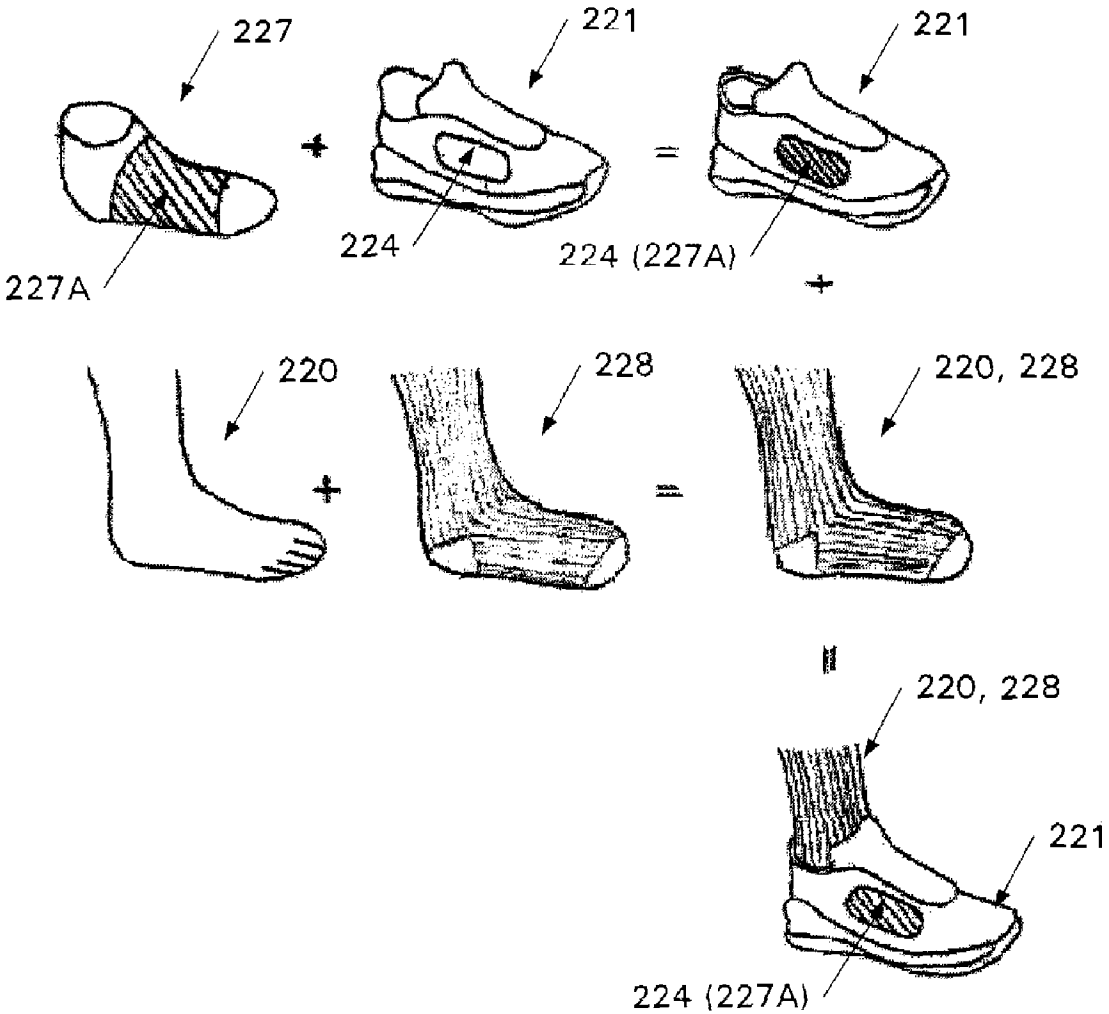
FIG. 23 is a diagram showing a two part innerliner and the steps for inserting the outer layer of an innerliner into footwear, for putting a user's foot into the inner layer of the innerliner, and for placing the inner layer covered foot into the combined footwear and outer layer to create the innerliner, according to an embodiment of the present invention.

FIG. 23 illustrates a method for inserting a multi-part innerliner into footwear. This method of inserting the innerliner into footwear 221 is similar to the method shown in FIGS. 22A and 22B except that the innerliner shown in FIG. 23 includes two parts, an outer layer 227 which is inserted directly into the footwear 221 and an inner layer 228, e.g., a sock, which is placed directly onto the user's foot 220. The user places the outer layer 227 of the innerliner directly into the footwear 221 and places the inner layer 228 of the innerliner onto the user's foot 220. Then, the user places the foot 220, which is covered by the inner layer 228, into the footwear 221, into which the outer layer 227 has already been inserted. The footwear 221 has a SDA 224 and the outer layer 227 of the innerliner has a displayable portion 227A that is visible through the SDA 224 when the outer layer 227 is placed in the footwear 221. Thus, the outer layer 227 of the innerliner and the footwear 221 are placed onto and removed from the user's foot 220 as a single unit. The outer layer 227 includes the displayable portion 227A, which includes, e.g., colors, designs, that are displayed by and can interact with the SDA 224 on the footwear 221. The inner layer 228 provides additional comfort, as well as moisture and heat dispersion characteristics. The inner layer 228 can also provide the characteristics for providing a predetermined internal spatial relationship during the interaction between the foot 220 and the footwear 221.

Thus, the innerliner can include more than one layer. After removing the inner layer 228 from inside the outer layer 227 and the footwear 221, the user may use the inner layer 228 like a normal sock. The usage of a two layers allows for frequent washing and substantial usage of the inner layer 228 outside of the footwear, without impacting the display characteristics of the outer layer 227. The outer layer 227 can remain in the footwear 221 while the inner layer 228 is removed with the user's foot 220, thereby limiting wear and tear on the outer layer 227, increasing the life of the displayable portion 227A of the innerliner, increasing the materials that can be effectively used in the innerliner, and significantly increasing the number and quality of appearances that can be displayed. The user can remove and interchange the outer layer 227 when the user wants to alter the combined appearance of the footwear.

Figure 24A:
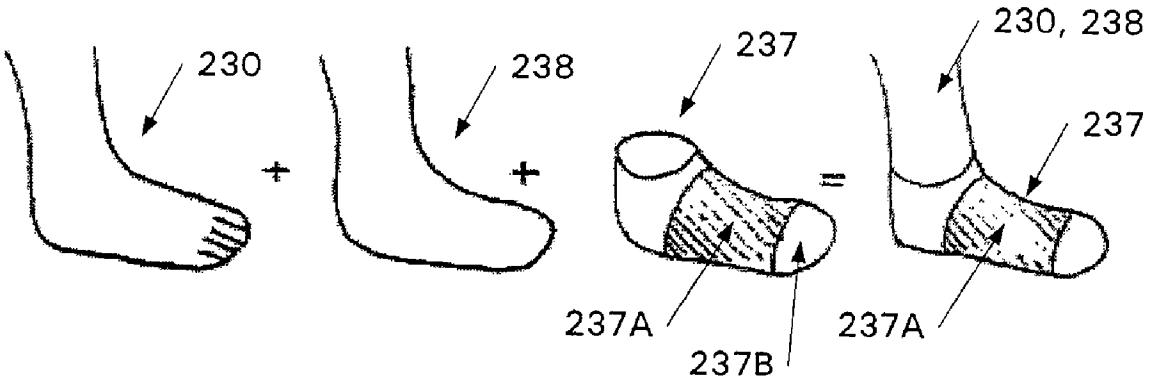
FIG. 24A is a diagram showing a two part innerliner and the steps for putting a user's foot into an inner layer and placing the inner layer covered foot into an outer layer in order to form the innerliner, according to an embodiment of the present invention.
Figure 24B:
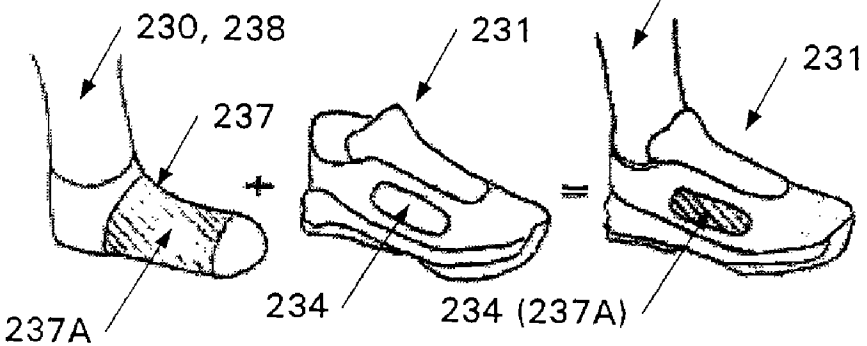
FIG. 24B is a diagram showing the steps for placing the user's foot and the innerliner of FIG. 24A into footwear.

FIGS. 24A and 24B illustrate another embodiment of a multi-part innerliner. FIGS. 24A and 24B illustrate footwear 231 having a SDA 234, an innerliner that includes an outer layer 237 having a displayable portion 237A and an inner layer 238, and the user's foot 230. As shown in FIG. 24A, the outer layer 237 and the inner layer 238 are both placed on the user's foot 230 with the outer layer 237 overlapping the inner layer 238. The outer layer 237 includes the displayable portion 237A, e.g., colors, designs, that are displayed by and interact with the SDA 234 on the footwear 231. The inner layer 238 provides additional comfort, as well as moisture and heat dispersion characteristics. The inner layer 238 also provides the characteristics for providing a predetermined internal spatial relationship during the interaction between the foot 230 and the footwear 231. As shown in FIG. 24B, the user's foot 230, the outer layer 237, and the inner layer 238 are inserted together into the footwear 231. Further, if the outer layer 237 does not cover the complete foot 230, e.g., if a toe area 237B is missing, the inner layer 238 can have a design or symbol in the region outside the outer layer 237, e.g., in the toe area 237B, which could be visible through another SDA, e.g., SDA 234 in FIG. 24B. Moreover, innerliners that do not cover the front or toe portion of the user's foot makes the innerliner more comfortable.

The relationship between the outer layer 237 and the inner layer 238 of the innerliner can vary depending on the particular model of the footwear system. For example, the outer layer 237 and the inner layer 238 are designed to limit the amount of movement between the two layers. Alternatively, the outer layer 237 and the inner layer 238 are designed to facilitate movement between the two layers. Furthermore, the outer layer 237 and the inner layer 238 can be designed to provide a full range of movement that lies between the extremes. Finally, the outer layer 237 and the inner layer 238 are designed to provide varying degrees of movement in different locations.

Thus, for the embodiment of the invention shown in FIGS. 23, 24A, and 24B, there are several potential relationships between the inner layer and outer layer of the innerliner.

The outer layer and the inner layer can be designed to limit the amount of movement between the two layers. In this embodiment, the materials and attributes of the outside of the inner layer and of the inside of the outer layer are designed to limit movement between the layers. The spatial relationship between the innerliner and the SDA on the footwear is similar to the spatial relationship between the innerliner and the SDA of the embodiment of the invention shown in FIG. 20. The spatial relationship between the outerlayer and SDA is mostly controlled by the relation of the innerliner to the foot, the relation of the innerliner to the footwear, and the relation of the foot to the footwear.

Alternatively, for the embodiment of the invention shown in FIGS. 23, 24A, and 24B, the outer layer and the inner layer are designed to facilitate movement between the two layers. In this embodiment of the invention, the materials and attributes of the outside of the inner layer and of the inside of the outer layer are designed to facilitate movement between the layers. This is accomplished by coating the outside of the inner layer and the inside of the outer layer with low friction materials such as silk, Teflon® or Emralon 329® Fluorocarbon Low Friction Coating. Thus, the outer layer can maintain its position in relation to the footwear, while the inner layer and the foot are provided with substantial freedom of movement, without disturbing the display of the innerliner through the SDA. The spatial relationship between the outer layer and SDA is mostly controlled by the relation of the outer layer of the innerliner to the inside surface of the footwear and SDA.

Finally, for the embodiment of the invention shown in FIGS. 23, 24A, and 24B, the outer layer and the inner layer can be designed to facilitate movement between the two layers in some locations while limiting movement between the two layers in other locations. In the embodiments of the invention that facilitate some movement between an inner layer and an outer layer of the innerliner, the outer layer can be temporarily connected to the inner layer at one or more points, e.g., by using Velcro®, clips, snaps, buttons or hooks, so that the outer layer of the innerliner is assured of being removed from the footwear together with the inner layer.

Figure 25B:
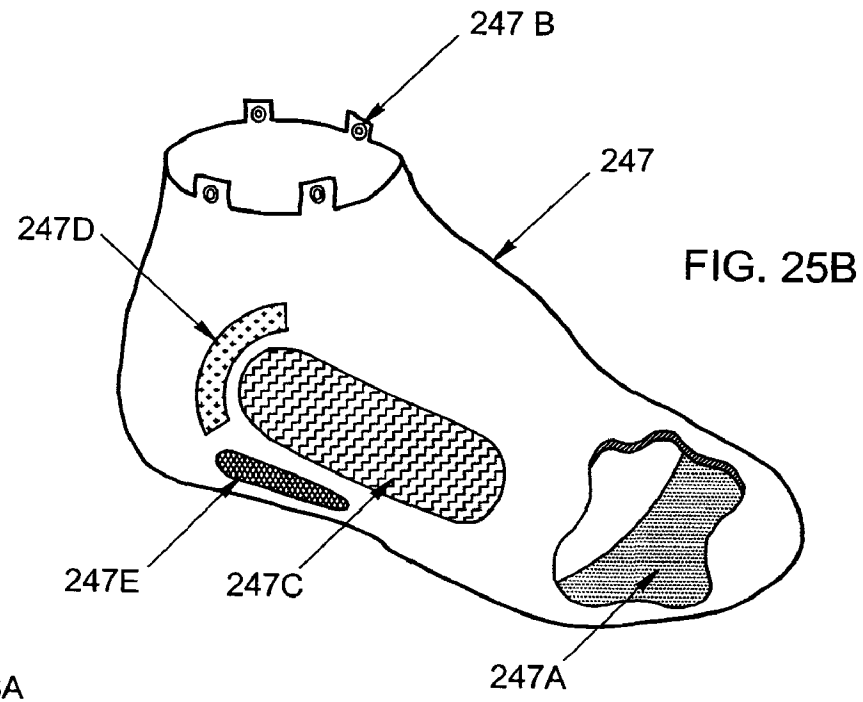
FIG. 25B is a perspective view of an outer layer adapted to be worn over the inner layer of FIG. 25A, according to an embodiment of the present invention.
Figure 25A:
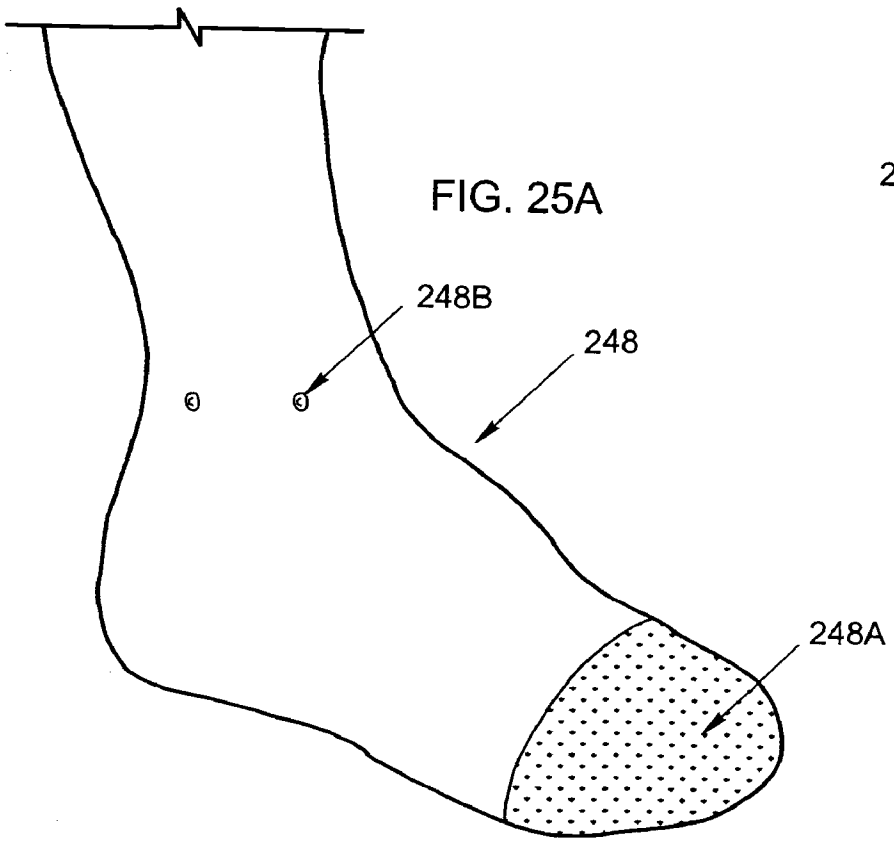
FIG. 25A is a perspective view of an inner layer of an innerliner.

FIGS. 25A and 25B illustrate an innerliner having an outer layer 247 (FIG. 25B) and an inner layer 248 (FIG. 25A) designed so that movement is facilitated between the two layers. The outer layer 247 has a portion 247C displayed through a SDA in the footwear (not shown). At least a portion 247A of the inside surface of the outer layer 247 includes materials described above that provide low resistance to movement against the material of at least a portion 248A of the outside surface of the inner layer 248 of the innerliner, thereby allowing substantial movement between the layers when the outer layer 247 is positioned on the inner layer 248.

In the embodiment of the invention shown in FIGS. 25A and 25B, the outer layer 247 and the inner layer 248 includes at least one of multiple mechanisms, a fastener such as snaps, Velcro®, hooks, buttons or clips for connecting the two layers at localized positions so that the user is assured of removing the outer layer 247 together with the inner layer 248 when the user's foot is removed from the footwear. As shown in FIGS. 25A and 25B, the outer layer 247 of the innerliner includes at least one snap 247B on a top edge thereof. The loops 247B on the outer layer 247 connect to at least one snap 248B on the inner layer 248. The embodiment of the invention shown in FIGS. 25A and 25B has a single way for attaching the outer and inner layers 247, 248 of the innerliners. However, it is to be understood that multiple types of fasteners as described above may be used to attach the outer and inner layers 247, 248.

In the embodiment of the invention shown in FIGS. 25A and 25B, the outer layer 247 also includes multiple mechanisms for limiting movement of the outer layer 247 in relation to the footwear. The outer layer 247 also includes at least one Velcro® patch 247D and a rubber strip 247E on an outside surface thereof. The Velcro® patch 247D and the rubber strip 247E on the outside surface of the outer layer 247 contact the inside surface of the footwear and cause the outer layer 247 to resist movement in relation to the corresponding area on the inside surface of the footwear. Thus, the embodiment of the invention shown in FIGS. 25A and 25B includes multiple ways for causing the outer layer 247 to resist movement against the inner surface of the footwear. However, it is to be understood that a single type of mechanism for resisting movement may be used.

Furthermore, an innerliner may be used that bears little resemblance to a typical sock. FIG. 26A illustrates an example of a "non-sock-like innerliner" device 250, that is used as an innerliner or the outer layer of an innerliner illustrated in the various innerliner embodiments shown in FIGS. 22A, 22B, 23, 24A, and 24B. The device 250 includes various areas 251 to be displayed through the SDA of correspondingly designed footwear and these areas 251 contain designs 253, such as a square, dots, and a triangle to enhance their appearance. In addition, the device 250 also acts as an inside portion of the footwear itself and can include various materials for providing support, fit and comfort. The exterior topography of the device 250 interrelates with the interior topography of corresponding footwear to hold the device 250 in place. For example, the areas 251 on the device 250 are recessed such that they would fit with SDA that protrude in relation to the surrounding interior surface of the footwear, thus helping to maintain the spatial relationship between the device 250, the SDA and the footwear. Similarly, the recessed portions 251 are also adapted to protrude from the device 250, such that they would to fit into SDA that are recessed in relation to the surrounding interior surface of the footwear. Finally, the raised portions 252 on the device 250 fit with recessed areas on the non-SDA portions of interior surface of the footwear creating interrelation strength and thus allowing further control over the spatial relationship between the device 250, the SDA and the footwear.

Figure 26B:
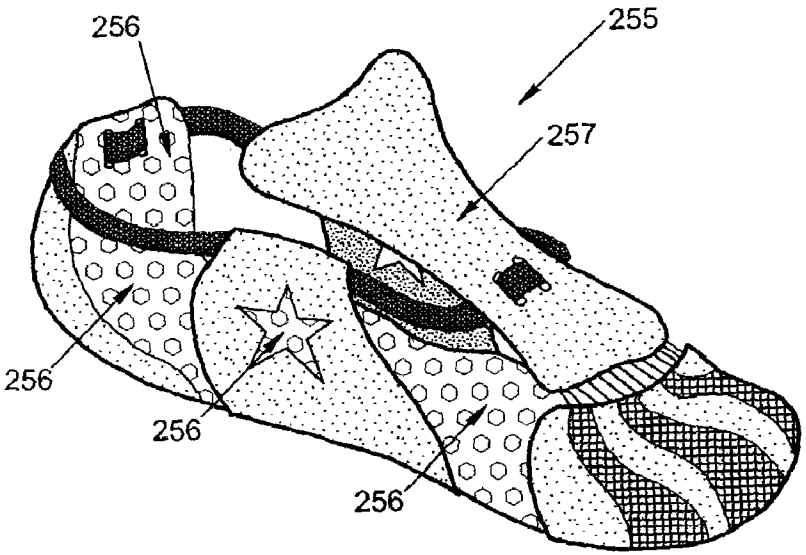
FIG. 26B is a perspective view of a "non-sock-like" liner that can serve as, an outer layer or an innerliner according to an embodiment of the present invention.
Figure 26A:
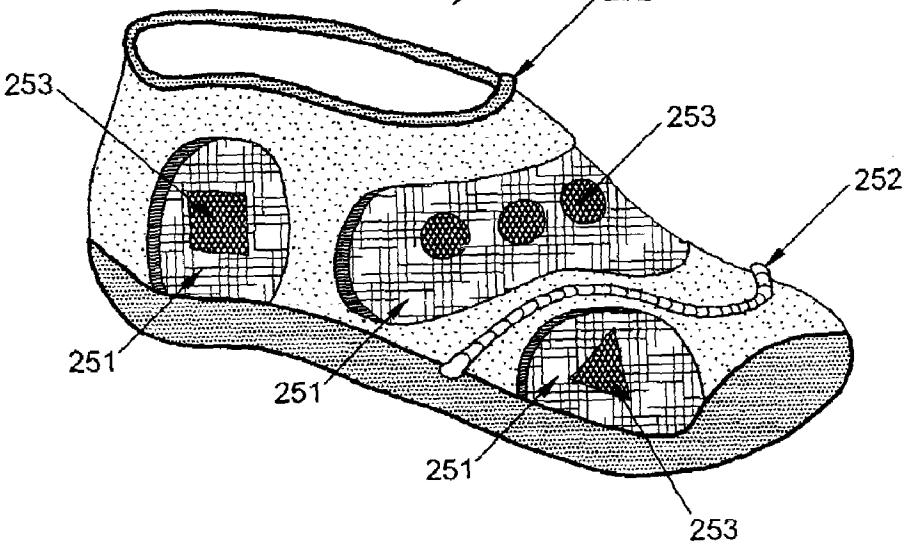
FIG. 26A is a perspective view of a "non-sock-like" liner that can serve as, an outer layer or an innerliner, according to an embodiment of the present invention.

FIG. 26B illustrates another example of a "non-sock-like innerliner" device 255 that is used as an innerliner or as the outer layer of an innerliner used in the various innerliner embodiments shown in FIGS. 22A, 22B, 23, 24A, and 24B. If the device 255 is used in the embodiment described in FIGS. 22A and 22B, then it is understood that the device 255 is an innerliner and would fit contiguously, but not continuously around the foot. If device 255 is used in a three-part footwear system (inner layer, outer layer, and footwear), then the device 255 is an outer layer. In this case, the outer layer fits contiguously around the inner layer, but does not necessarily fit continuously around the inner layer. The entire exterior surface of the outer layer 255 does not necessarily fit continuously around the inner layer since the outer layer 255 includes openings 256. On device 235 there are areas 238 that are designed to be displayed through SDA. One of the areas 238 has a star-shaped opening which is designed to allow the inner layer to be visible from underneath the outer layer 255. Thus, the inner layer is used to provide appearances that are visible through the outer layer 255 and thus can be displayed by a SDA and contribute to the combined appearance of the footwear.

The device 255 acts as an inside portion of the footwear and can include various materials for providing structure, topography, and fit. The exterior topography of the outer layer 255 matches the interior topography of the footwear to hold the outer layer 255 in place. For example, the outer layer 255 includes a tongue piece 257 that is received within a corresponding recessed portion in the footwear. The tongue piece is excluded from the footwear in this embodiment of the present invention.

It is to be understood that the present invention is not limited to the colors, designs, and illustrations disclosed in the embodiments described above and that other colors, designs, and illustrations may be used to provide similar effects. Furthermore, one or more of the aspects described above may be employed, alone or in combination, with footwear with an SDA and an innerliner designed to be used in combination with the footwear.

Having described embodiments of the invention with reference to the accompanying drawings, it is to be understood that the invention is not limited to those precise embodiments, and that various changes and modifications may be effected therein by one skilled in the art without departing from the scope or spirit of the invention as defined in the appended claims.

We claim:

1. A footwear system comprising:

at least a first shoe having a sole and a upper;

at least one removable innerliner that is disposed within an interior of the first shoe and constructed to be worn on a foot, the innerliner consisting of a plurality of target areas containing visual content that is intended to be visibly displayed when the innerliner is mated with the shoe and other areas of the inner liner outside of the target areas; said other areas having a different appearance than the target areas, wherein the upper consists of a plurality of display areas that correspond with each of the target areas of visual content to permit viewing of the visual content through the respective and corresponding display area, the display areas being completely bordered by adjacent sections of the upper that each has a different appearance than an appearance of the material that forms the display areas;

wherein said at least one innerliner is adapted to be interchangeable with said shoe such that when said innerliner is mated with said shoe, the content is visible through the material forming said display area and the other areas outside of the target areas are not visible therethrough.

2. A footwear system according to claim 1, wherein each display area is at least one of transparent, semi-transparent, or translucent.

3. A footwear system according to claim 1, wherein at least one display area includes effects for the appearance of said innerliner.

4. A footwear system according claim 1, wherein the innerliner includes a foot contacting surface and a shoe contacting surface and wherein the other areas include a first section that has an appearance different than appearances of each of the target areas and is disposed adjacent the display areas, the target areas of the innerliner being disposed on the shoe contacting surface, at least one display area being formed along one side of the upper.

5. A footwear system according to claim 1, wherein the adjacent section completely surrounds the display area and is opaque.

6. A footwear system according to claim 1, wherein at least one target area includes text that is completely visible through the one corresponding display area.

7. A footwear system according to claim 1, wherein the visual content of at least one target area is completely visible through the corresponding display area.

8. The footwear system according to claim 1, wherein the visual content of one target area includes text formed by letters having a varying scale and the corresponding display area is defined by a border having a varying height that complements the varying scale of the letters.

9. The footwear system according to claim 8, wherein the entire text is visible through the display area.

10. The footwear system according to claim 1, wherein the visual content of one target area is formed vertically along a side of the innerliner and the corresponding display area is formed vertically within the upper.

11. The footwear system of claim 1, wherein at least one target area is selected to be located along axes of the innerliner that effectively place its visual content in registration with the material forming the corresponding display area, the size of the visual content being selected based on the size of the corresponding display area so as to permit the entire visual content to be seen through the corresponding display area.

12. The footwear system of claim 1, wherein a spatial position of the target areas relative to other areas of the innerliner is specifically selected in view of a spatial position of the corresponding display areas relative to other areas of the upper so as to place the two in registration with one another when the innerliner is inserted into the shoe.

13. The footwear system of claim 1, wherein the visual content includes at least one of an image, text, and an area of one or more colors.

14. The footwear system of claim 1, wherein the visual content of each target area has a different appearance.

15. A footwear system comprising:

at least a first shoe having a sole and a upper, wherein the upper consists of a plurality of display areas, the display areas being completely bordered by adjacent sections of the upper that have a different appearance than an appearance of the material that forms the display areas; and at least one removable innerliner that is disposed within an interior of the first shoe and constructed to be worn on a foot, the innerliner consisting of a plurality of target areas containing visual content that is intended to be visibly displayed when the innerliner is mated with the shoe and other areas of the inner liner outside of the target areas, said other areas having a different appearance than the target areas, the target areas of visual content corresponding with each of the plurality of display areas to permit viewing of the visual content through the respective and corresponding display areas, and wherein the at least one innerliner is adapted to be interchangeable with said shoe such that when said innerliner is mated with said shoe, the content is visible through the material forming the display area.

16. The footwear system of claim 15, wherein the innerliner includes secondary areas that surround the target areas and have different appearances than the target areas, the secondary areas being obscured and hidden by the adjacent sections of the upper.

17. A footwear system comprising:

at least a first shoe having a sole and an upper;

at least one removable innerliner that is disposed within an interior of the first shoe and constructed to be worn on a foot; the innerliner consisting of a plurality of target images that are intended to be visibly displayed when the inner liner is mated with the first shoe and other areas of the inner liner outside of the target images, said other areas having a different appearance than the target images, the target images being selected from a group consisting of a graphic illustration, text, color and a combination thereof;

wherein the upper consists of a plurality of display areas that correspond with each of the target images to permit viewing of the underlying target images through the respective and corresponding display areas, the display areas being spaced apart from one another and completely bordered by adjacent sections of the upper that have different appearances than an appearance of the material that forms the display areas; and wherein the innerliner is adapted to be interchangeable with the shoe such that when the innerliner is mated with the shoe, the target images match with and are in registration with the corresponding display areas so that the target images are visible through the material forming the display areas.

* * * * *